US008997873B2

(12) United States Patent
Riordan et al.

(10) Patent No.: US 8,997,873 B2
(45) Date of Patent: Apr. 7, 2015

(54) IN SITU TRANSFER AND SUPPORT OF TENSIONED SYSTEM AND METHOD FOR A FLEXIBLE LINK

(75) Inventors: Brian Riordan, Brookshire, TX (US); Mathieu Boisne, Houston, TX (US); Tobias G. Selcer, Spring, TX (US); Jacy Lee Robbins, Houston, TX (US); Ange Luppi, Nimes (FR)

(73) Assignee: Technip France, Courbevoie (FR)

( * ) Notice: Subject to any disclaimer, the term of this patent is extended or adjusted under 35 U.S.C. 154(b) by 643 days.

(21) Appl. No.: 13/323,294

(22) Filed: Dec. 12, 2011

(65) Prior Publication Data

US 2013/0146300 A1 Jun. 13, 2013

(51) Int. Cl.
*E21B 17/01* (2006.01)

(52) U.S. Cl.
CPC ..... *E21B 17/015* (2013.01)

(58) Field of Classification Search
CPC ..... E21B 17/012; E21B 17/015
USPC ..... 166/343, 339, 350, 367; 405/171, 405/224.2–224.4; 441/23–26, 133
See application file for complete search history.

(56) References Cited

U.S. PATENT DOCUMENTS 1,316,294 A * 9/1919 Freed ..... 254/232
1,714,187 A * 5/1929 Pacy ..... 29/897.1
2,654,796 A * 10/1953 Hubbard ..... 254/232
3,641,602 A * 2/1972 Flory et al. ..... 441/5
3,894,567 A * 7/1975 Mott et al. ..... 141/388
4,082,050 A * 4/1978 van Heijst ..... 114/53
4,130,076 A * 12/1978 van Bilderbeek ..... 441/5
7,097,154 B2 * 8/2006 Stevens ..... 254/233
2008/0054235 A1 * 3/2008 Devine et al. ..... 254/134.3 PA

FOREIGN PATENT DOCUMENTS

WO 2009156695 12/2009
WO 2011007084 1/2011

OTHER PUBLICATIONS

PCT International Search Report for PCT Application PCT/US12/068558 dated Feb. 10, 2014.
Written Opinion for PCT Application PCT/US12/068558 dated Feb. 10, 2014.

* cited by examiner

*Primary Examiner* — Matthew Buck
(74) *Attorney, Agent, or Firm* — Locke Lord LLP

(57) ABSTRACT

The disclosure provides an in-situ system and method for transferring a load from a tensioned flexible link between at least two bodies, such as between a buoyancy can and a subsea riser or between a moored offshore platform and a pile. The system and method provides a tether assembly having a hydraulic cylinder and/or a transfer assembly, where the hydraulic cylinder is configured upon actuation to decrease a distance between the two bodies; and the transfer assembly includes a mechanical interlock configured upon actuation to maintain the decreased distance between the two bodies independent of the hydraulic cylinder. The mechanical interlock can include various embodiments that can be selectively activated and deactivated position to allow the hydraulic cylinder to operate at various times in the transfer process. A support assembly can provide additional support to the flexible link independent of or in addition to the transfer assembly.

31 Claims, 31 Drawing Sheets

IN SITU TRANSFER AND SUPPORT OF TENSIONED SYSTEM AND METHOD FOR A FLEXIBLE LINK

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention relates to tensile loads on flexible links, such as cables and chains, and the transfer of at least a portion of the load to an element other than the flexible link while the load is supported. More specifically, the invention relates to systems supporting a load with a flexible link, such as a floatation system with a buoyancy can supporting a riser or a system for mooring an offshore platform to a piling, and transferring at least a portion of the load from the flexible link to another element while the system continues to support the load.

2. Description of the Related Art

FIG. 1 is a schematic side view of a prior art floatation system having a buoyancy can supporting a subsea riser. A known floatation system 2 described in PCT Publication No. WO 2009/156695 A1 supports a subsea production riser 4 coupled to an underground well 6 below the seabed 8. The riser 4 is connected to a catenary production line 10 that provides a conduit for oil and gas fluids to a storage tank 12 floating on the surface 14 of the sea. The floatation system 2 includes a buoyancy can 16 with a chain, cable or other flexible link 18 connected to a riser support connection 20. The riser connection 20 in turn is connected to the riser 4.

The stability and operational integrity of the riser 4 depends on the buoyancy can 16 and the flexible link 18 connected between the can and the riser. Periodically, the flexible link 18 may need replacement or repair. However, with the buoyancy can 16 placed in service with a tensile load on the flexible link, replacement or repair of the flexible link can be difficult. The flexible link cannot be removed without compromising the function of the buoyancy can to support the riser.

FIG. 2A is a schematic perspective view of an alternative prior art floatation system with multiple cables. FIG. 2B is a schematic detail perspective view of an upper connector. FIG. 2C is a schematic detail perspective view of a lower connector. The figures will be described in conjunction with each other. One alternative system disclosed in PCT Publication No. WO 2011/007084 A1 provides multiple cables 42A, 42B, 42C (generally "42") connected between the buoyancy can 16 and the riser support connection 20. One end of the cables 42 is connected to an upper connector 22 that is connected to the buoyancy can 16. The other end of the cables is connected to a lower connector 36 that is connected to the riser support connection 20, which in turn is connected to the riser 4. The upper connector 22 has protruding lugs 24 that are formed with an end cap 26 and a shoulder 28 having a reduced cross sectional area compared to the end cap. The upper connector 22 also has a centrally formed upper keyhole 30 having an opening 32 and a slot 34 below the opening with a smaller cross sectional distance than the opening 32. Similarly, the lower connector 36 has protruding lugs 38 that are formed with an end cap and a shoulder, and a lower keyhole 40. The cables 42 are removably connected between upper and lower lugs 24, 38. The floatation of the buoyancy can 16 and the weight of the riser 4 provides tension to the cables, so that the cables 42 remain connected between the lugs 24, 38 in normal operation.

FIG. 3A is a schematic side view of the prior art floatation system of FIGS. 2A-2C with a broken cable. FIG. 3B is a schematic side view of the system of FIG. 3A with an ROV initiating repair functions. FIG. 3C is a schematic side view of a hydraulic cylinder and tether installed for repairs of the system of FIG. 3A. FIG. 3D is a schematic side view of an ROV supplying a replacement cable to the system of FIG. 3A. FIG. 3E is a schematic side view of the ROV removing the hydraulic cylinder and tether after repair. The figures will be described in conjunction with each other.

If a cable, such as cable 42C, needs repair or replacement, the remaining cables 42A, 42B maintain the floatation system 2 during repairs. A remote operated vehicle ("ROV") 44 supplies a tether 46 and a hydraulic cylinder 48 to the floatation system. The ROV 44 attaches an upper tether end 50 of the tether 46 into the upper keyhole 30 of the upper connector 22 and the hydraulic cylinder to the lower keyhole 40 of the lower connector 36. The hydraulic cylinder is pressurized to tension the tether and pull the two connectors 22, 36 toward each other. The ROV supplies a new cable 42D and places the new cable on the lugs 24, 38 of the connectors 22, 36, respectively, while the cylinder 48 is actuated and the two connectors are pulled closer. The hydraulic cylinder pressure is released to deactivate the cylinder, and the two connectors 22, 36 are allowed to separate so that the cables 42 are tensioned again. The tether and hydraulic cylinder are removed, and the system can resume normal operational status.

FIG. 4 is a perspective view of another alternative prior art floatation system. The floatation system is similar to the one described in references to the above figures, but further includes two tethers 46 and two hydraulic cylinders 48, one set on each side of the cables 42. The tethers are each illustrated having two tether portions 46A, 46B. Separate upper lugs 52A, 52B laterally disposed on the buoyancy can 16 and separate lower lugs 54A, 54B laterally disposed on the riser support connection 20 are used for the tethers and hydraulic cylinders instead of the keyholes 30, 40 on the connectors 22, 36, respectively.

Despite the various features of the above described floatation systems, the systems rely on hydraulic pressure in a hydraulic cylinder to remain constant when activated during the repair operations. If the fluid leaks and the pressure decreases, then the connectors separate and the repair may not be completed. The hydraulic system not maintaining pressure under such adverse conditions can compromise the repair operations. The expense can be significant with the costs of the ROV rental, support ship, downtime, and related costs.

Other systems with a tensile load thereon have similar challenges. As another example, mooring lines between an offshore platform and a pile in the seabed can require repair. Yet, the logistics of transferring the load from the mooring line for a period of time during the repair can be challenging, as described more fully in WO 2010/127220. The location of the system, size, and accessibility can cause significant expense in replacing or repairing a member that supports the load between two bodies.

Therefore, there remains a need to provide an improved system and method for repair and other transfers from a tensioned cable.

BRIEF SUMMARY OF THE INVENTION

The disclosure provides an in-situ system and method for transferring a load from a tensioned flexible link between at least two bodies, such as between a buoyancy can and a subsea riser or between a moored offshore platform and a pile. The flexible link can include cables, chains, ropes, and other flexible elements that can restrict a separation distance of the two bodies. The system and method provides a tether assembly having a hydraulic cylinder and a transfer assembly, where the hydraulic cylinder is configured upon actuation to decrease a distance between the two bodies; and the transfer assembly includes a mechanical interlock configured upon actuation to maintain the decreased distance between the two bodies independent of the hydraulic cylinder. The mechanical interlock can include various embodiments that can be selectively activated and deactivated position to allow the hydraulic cylinder to operate at various times in the transfer process. In at least some embodiments, the transfer assembly can include a transfer leg and a receptacle with a variety of couplers that allow adjustment and locking of the transfer leg relative to the receptacle. A support assembly can provide additional support to the flexible link independent of or in addition to the transfer assembly.

The present disclosure provides a system for in-situ transfer of at least a portion of a tensile load from a flexible link coupled between at least two bodies, comprising: a first tether assembly coupled between the two bodies and comprising at least one hydraulic cylinder with a cylinder rod slidably disposed therein and at least one transfer assembly, the hydraulic cylinder being configured upon actuation to decrease a distance between the two bodies and thereby transfer at least a portion of the tensile load from the flexible link to the tether assembly; and the transfer assembly comprising: a first transfer block; a second transfer block; the hydraulic cylinder coupled between the transfer blocks; and a mechanical interlock configured upon actuation to maintain the decreased distance between the two bodies with at least a portion of the tensile load transferred to the tether assembly independently of the The present disclosure also provides a method of in-situ transferring at least a portion of a tensile load from a flexible link coupled between two bodies, comprising: coupling at least one tether assembly between the two bodies with a first distance established between the two bodies, the tether assembly having a transfer assembly with at least two transfer blocks and a hydraulic cylinder with an associated cylinder rod coupled between the transfer blocks; activating the hydraulic cylinder to move the two transfer blocks from the first distance to a second distance that is less than the first distance and thereby moving the two bodies closer; and mechanically interlocking the transfer assembly at the second distance independent of tension applied by the hydraulic cylinder to the transfer assembly.

The present disclosure also provides a system for in-situ support of at least two bodies having a flexible link coupled between the bodies with the flexible link having a tensile load, comprising: a support assembly coupled between the two bodies in addition to the flexible link, comprising: an upper support block coupled to an upper portion of the flexible link; a lower support block coupled to a lower portion of the flexible link distal from the upper portion of the flexible link; and at least one support link coupled between the upper support block and lower support block, the support link at least partially having a rigid rod with a fastening portion and configured to cause a distance between the upper support block and the lower support block to be adjusted.

The present disclosure provides a method for supporting at least two bodies having a flexible link coupled between the bodies with the flexible link having a tensile load, comprising: coupling a first support block of a support assembly to a first portion of the flexible link between the two bodies; allowing a support link coupled to the first support block to pivot to bring a second support block coupled to the support link distal from the first support block into proximity to a second portion of the flexible link between the two bodies that is distal from the first portion of the flexible link; and coupling the second support block of the support assembly to the second portion of the flexible link distally from the first portion of the flexible link.

DETAILED DESCRIPTION

Figure 1:
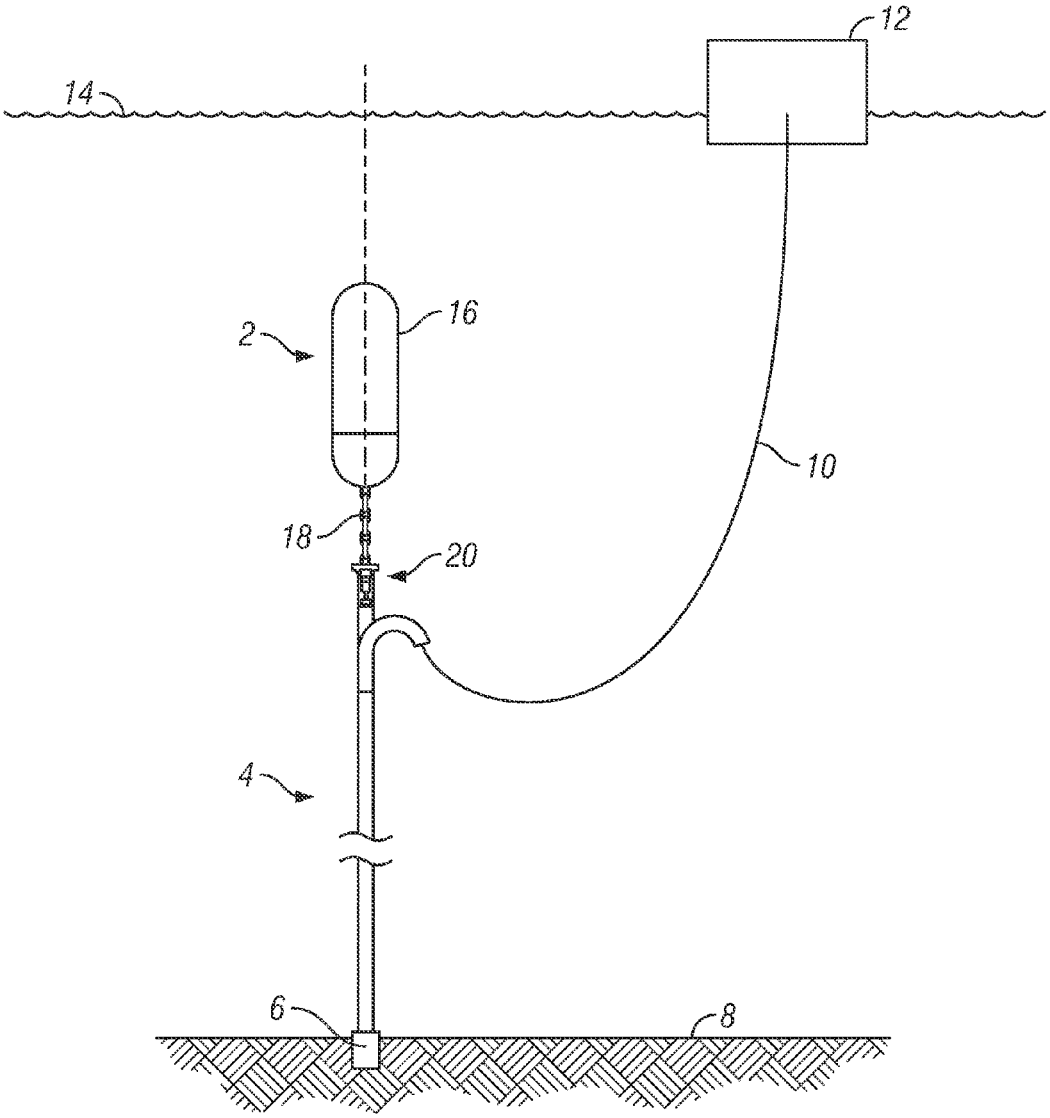
FIG. 1 (Prior Art)
FIG. 1 is a schematic side view of a prior art floatation system supporting a subsea riser.
Figure 2A:
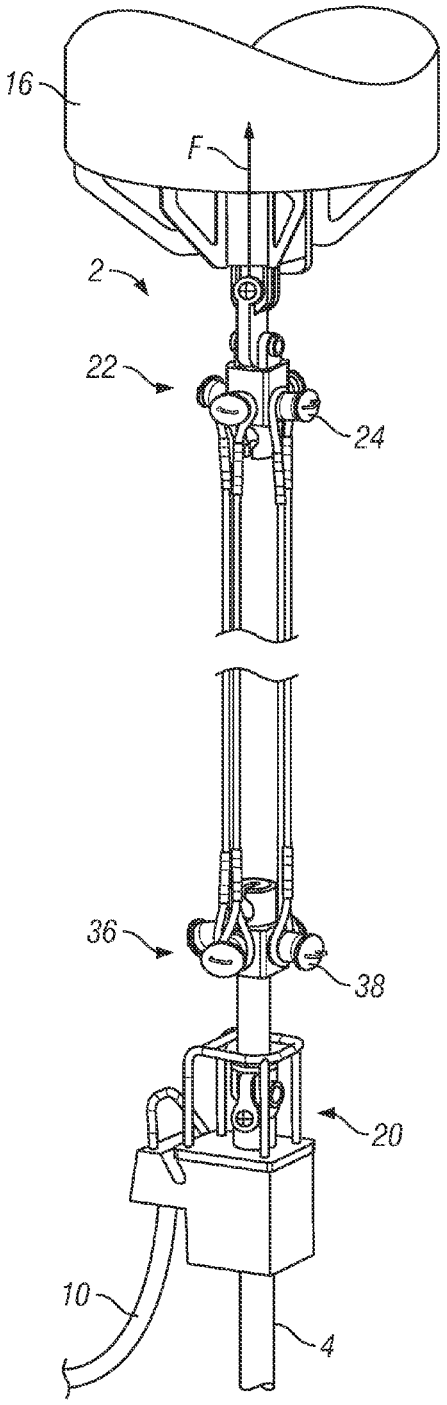
FIG. 2A (Prior Art)
FIG. 2A is a schematic perspective view of an alternative prior art floatation system with multiple cables.
Figure 2B:
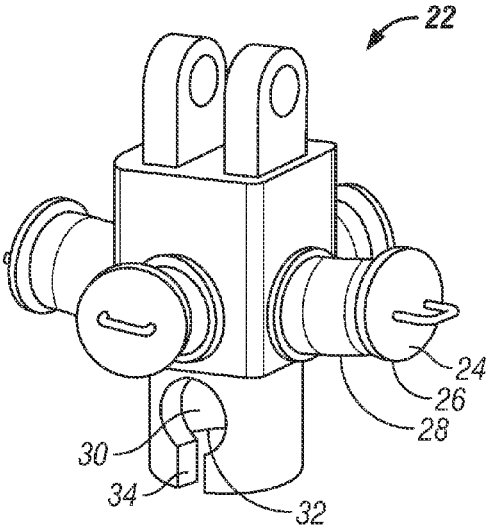
FIG. 2B (Prior Art)
FIG. 2B is a schematic detail perspective view of an upper connector.
Figure 2C:
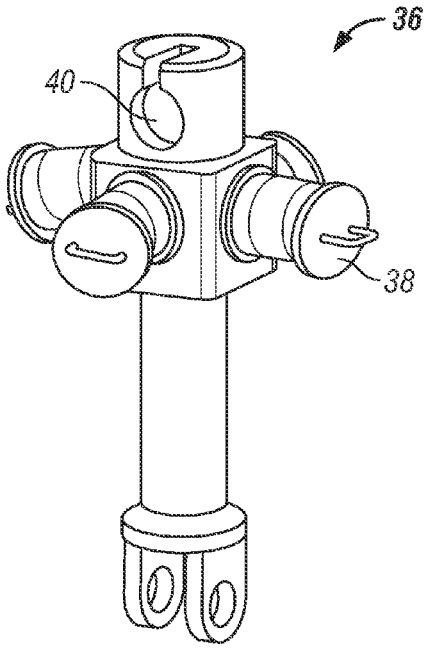
FIG. 2C (Prior Art)
FIG. 2C is a schematic detail perspective view of a lower connector.
Figure 3B:
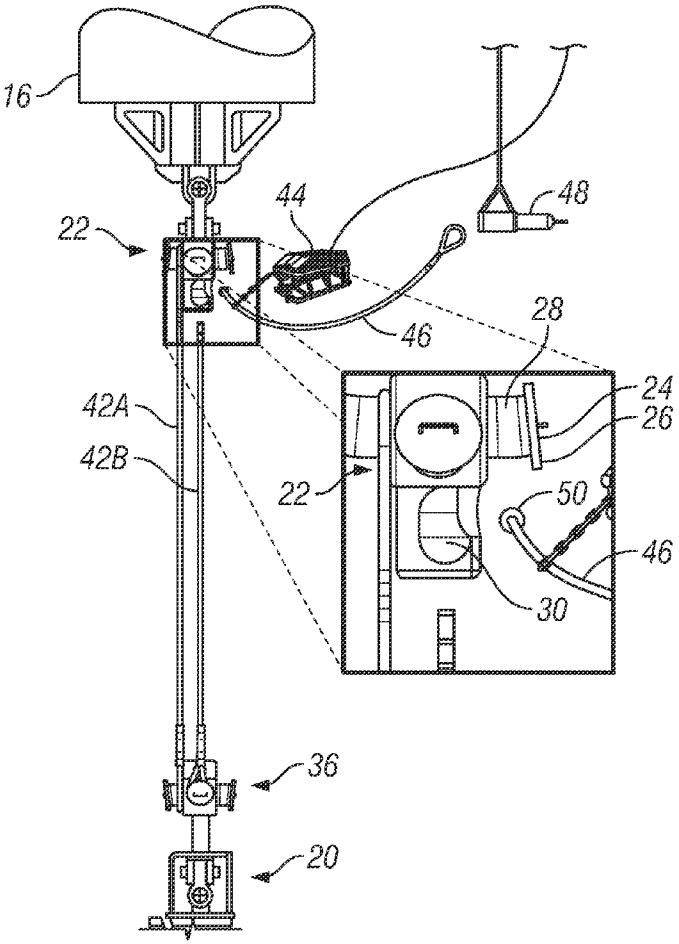
FIG. 3B (Prior Art)
FIG. 3B is a schematic side view of the system of FIG. 3A with an ROV initiating repair functions.
Figure 3A:
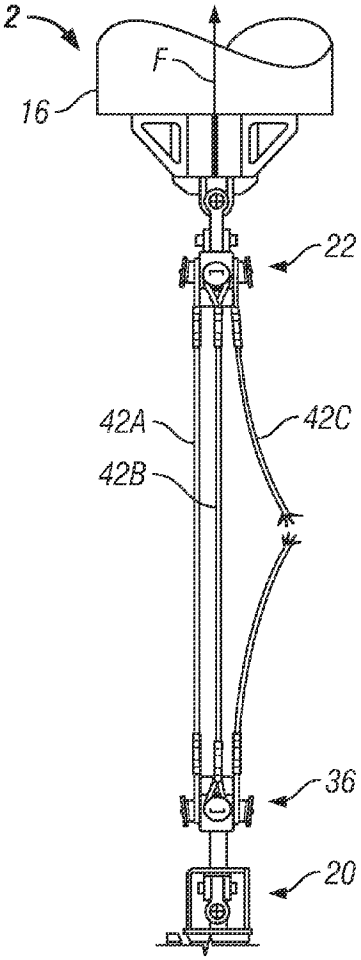
FIG. 3A (Prior Art)
FIG. 3A is a schematic side view of the prior art floatation system of FIGS. 2A-2C with a broken cable.
Figure 3E:
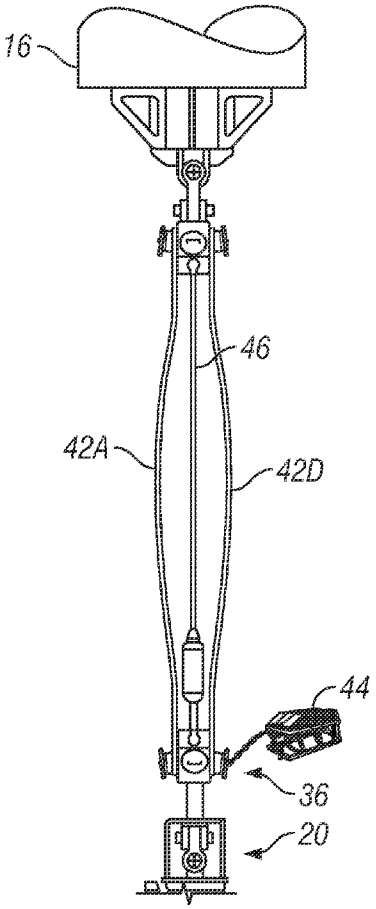
FIG. 3E (Prior Art)
FIG. 3E is a schematic side view of the ROV removing the hydraulic cylinder and tether after repair.
Figure 3D:
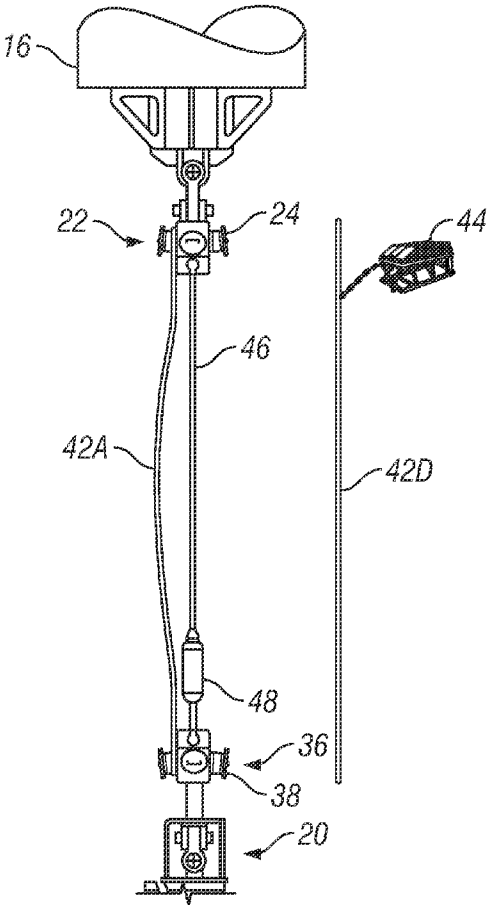
FIG. 3D (Prior Art)
FIG. 3D is a schematic side view of an ROV supplying a replacement cable to the system of FIG. 3A.
Figure 3C:
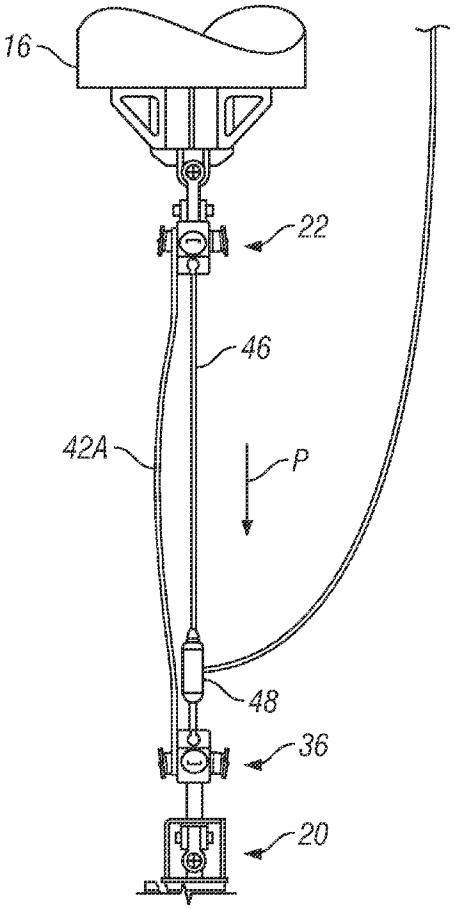
FIG. 3C (Prior Art)
FIG. 3C is a schematic side view of a hydraulic cylinder and tether installed for repairs of the system of FIG. 3A.
Figure 4:
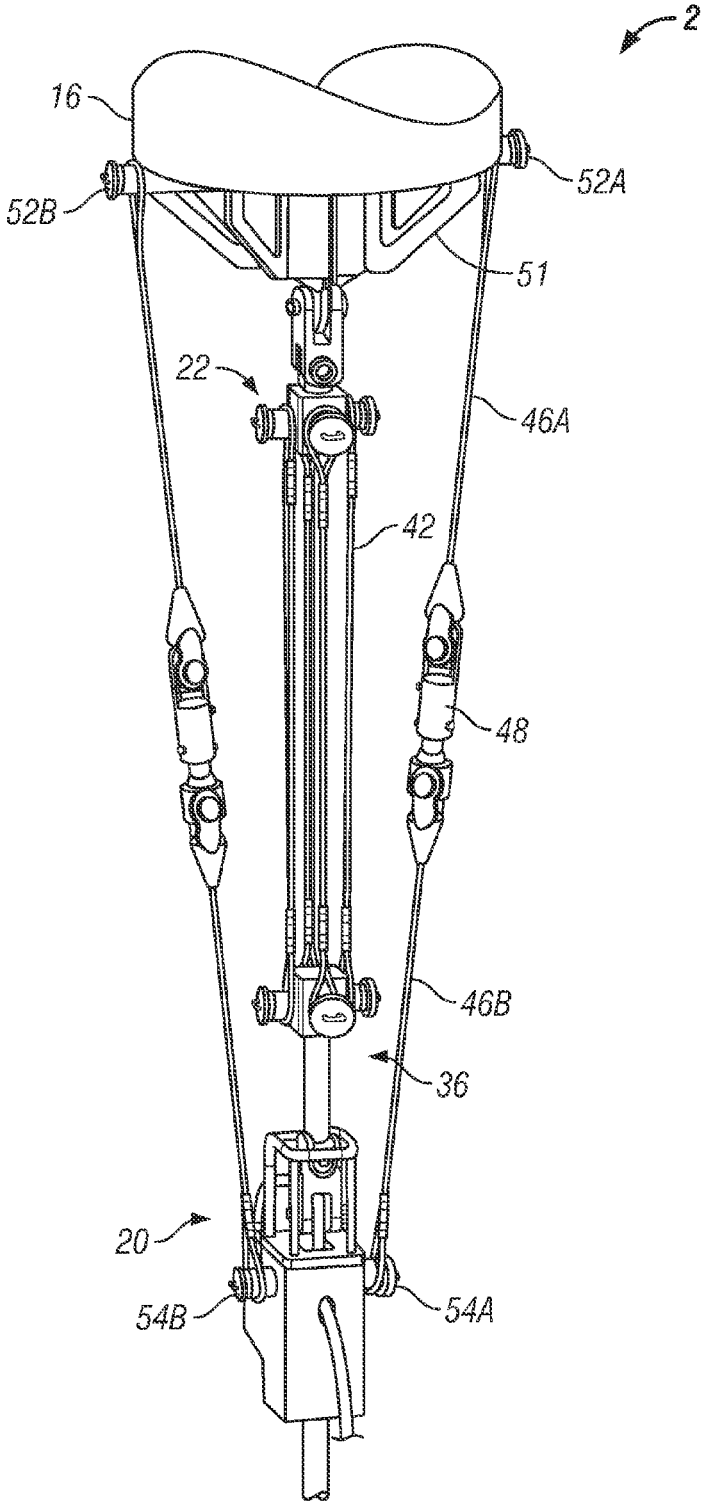
FIG. 4 (Prior Art)
FIG. 4 is a perspective view of another alternative prior art floatation system.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "A" or "B" to designate one portion of the system or another. When referring generally to such elements, the number without the letter is used. Further, such designations do not limit the number of elements that can be used for that function.

The disclosure provides an in-situ system and method for transferring a load from a tensioned flexible link between at least two bodies, such as between a buoyancy can and a subsea riser or between a moored offshore platform and a pile. The flexible link can include cables, chains, ropes, and other flexible elements that can restrict a separation distance of the two bodies. The system and method provides a tether assembly having a hydraulic cylinder and a transfer assembly, where the hydraulic cylinder is configured upon actuation to decrease a distance between the two bodies; and the transfer assembly includes a mechanical interlock configured upon actuation to maintain the decreased distance between the two bodies independent of the hydraulic cylinder. The mechanical interlock can include various embodiments that can be selectively activated and deactivated position to allow the hydraulic cylinder to operate at various times in the transfer process. In at least some embodiments, the transfer assembly can include a transfer leg and a receptacle with a variety of couplers that allow adjustment and locking of the transfer leg relative to the receptacle.

Figure 5A:
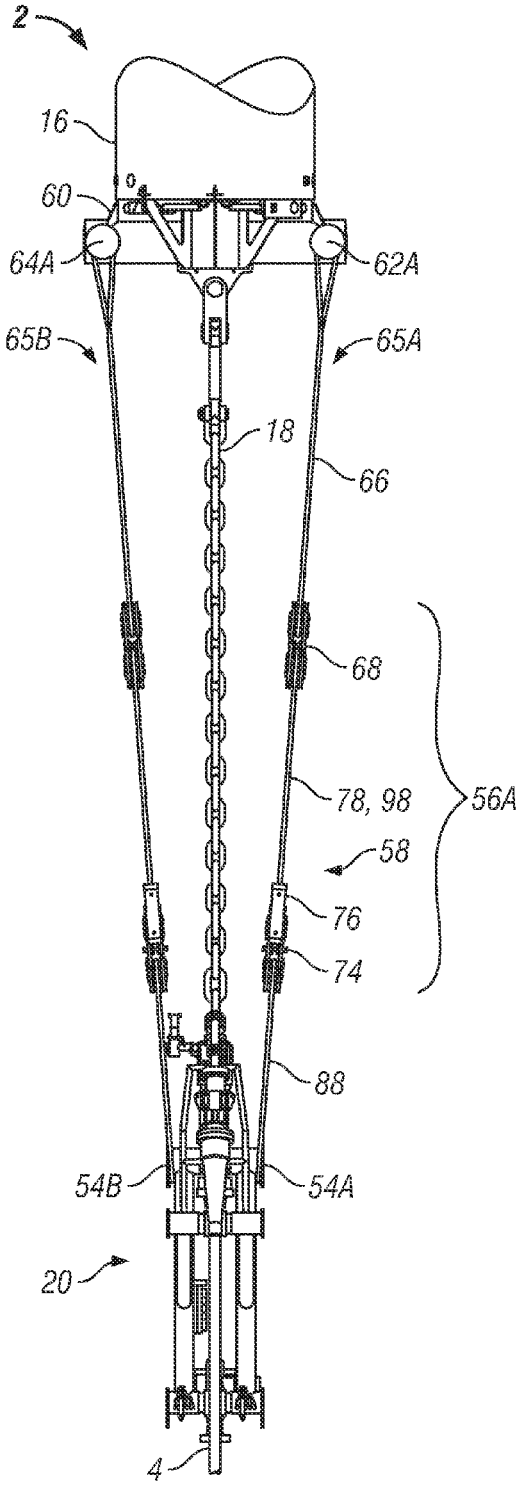
FIG. 5A is a schematic front view of an exemplary system of the present invention.
Figure 5B:
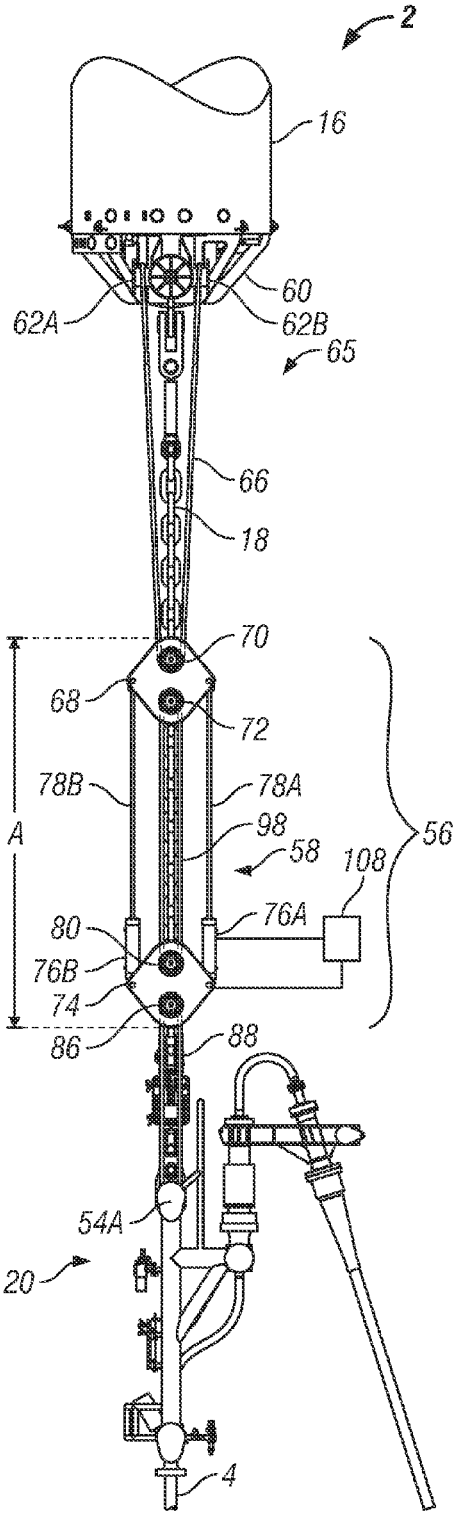
FIG. 5B is a schematic side view of the exemplary system of FIG. 5A.

FIG. 5A is a schematic front view of an exemplary system of the present invention. FIG. 5B is a schematic side view of the exemplary system of FIG. 5A. The figures will be described in conjunction with other. In general, the invention applies to at least two bodies with a flexible element therebetween having a tensile load.

A floatation system 2 generally includes a buoyancy can 16 coupled through a flexible link 18 to a riser support connection 20. The flexible link 18 can be a chain, cable, rope, or other flexible member that can restrict the separation or distance between the buoyancy can and the riser support connection. Due to the very large size of the buoyancy can for the weight of the riser with the riser support connection, the present invention provides a system and method of in-situ replacement or repair of the flexible link 18, so that the buoyancy can continue to support the riser support connection during the replacement or repair of the flexible link.

When a replacement or repair is initiated, one or more tether assemblies 65A, 65B can be coupled between the buoyancy can 16 and the riser support connection 20. The coupling generally can occur whenever there is a need to repair, replace, or otherwise disconnect the flexible link 18 that is used to primarily couple the buoyancy can 16 to the riser connection 20 during normal operation. The coupling generally can alternatively occur at some time prior to needing repair, replacement, or other disconnection, such as on initial installation of the floatation system for use at a later time. In the exemplary floatation system, the buoyancy can 16 can include a lug frame 60 on a lower portion of the buoyancy can. The lug frame 60 can have one or more, and generally a plurality of, lugs 62, 64. In the illustrated embodiment, the lugs can appear in pairs to allow a balanced loading for a sling 66 coupled to the lugs 62A, 62B. Similarly, the lug 64 can be provided as a pair of lugs. It is to be understood that the illustrated lugs are only one means of allowing a removable coupling for the slings and other connectable elements described herein, and thus the term "lug" is used broadly. Further, in some embodiments, the tether assemblies can remain coupled between the buoyancy can and the riser support connection, such as when it is desired for the tether assemblies to be used for future operations. Further, the term "sling" is used broadly and can include wire rope, cables, chain, and the like as flexible members and can also include rigid members, such as rods, bolts, and the like.

The tether assemblies 65A, 65B (generally "65") generally includes one of more slings 66, 88 and at least a transfer assembly 56 disposed at some location in the tether assembly 65. While the embodiment illustrates slings on either end of the transfer assembly 56, such an arrangement is only exemplary and the transfer assembly 56 could be coupled to one or both of the lugs 62A. 64A in this and the other embodiments described herein. Also, as a practical application, it is envisioned that generally slings will be used for each of coupling points to the lugs, and thus is illustrated as such. The sling 66 can be used to couple an upper portion of the transfer assembly 56 to the buoyancy can 16 and its associated lug 62. The sling 88 can be used to couple the lower portion of the transfer assembly 56 to the riser support connection 20 and its associated lug 54. The riser connection lug 54 can be in the form of a pair of lugs 54A, 54B, so that the tether assembly 65A can be coupled between the lug 62A on the buoyancy can 16 and the corresponding lug 54A at the riser support connection 20, and the tether assembly 65B can be coupled between the lug 62B and the corresponding lug 54B.

The transfer assembly 56 can include several subcomponents. In the illustrated embodiment, the transfer assembly 56 can include an upper transfer block 68 coupled the sling 66 and a lower transfer block 74 coupled to the sling 88, as viewed from the nonlimiting orientation of the exemplary drawings. The transfer assembly 56 can further include one or more hydraulic cylinders 76, such as cylinders 76A, 76B, with their respective cylinder rods 78A, 78B, which are coupled between the transfer blocks 68, 74. The transfer block 68 can include a pulley 70 around which the sling 66 can be coupled, so that the ends of the sling 66 are coupled to the lug 62A, 62B on the buoyancy can 16. The term "pulley" is used broadly and includes a rotatable element for a flexible link at least partially wound around a surface on the rotatable element, and can include a pulley for rope and cable, a sprocket for chain, and other rotatable elements. A variation of the above-described transfer assembly 56 is that the pulleys 70, 86 are fixed rotationally, so that the pulleys simply form a curved member around which the slings 66, 88 can be wound. Further, the upper transfer block 68 can include a second pulley 72 that is coupled through an intermediate transfer leg 98 (which can be a sling) as a coupler to a second pulley 80 on the lower transfer block 74. When the tether assembly 65 is installed or setup, the transfer assembly 56 has a length "A" which can be arbitrarily measured between the top and bottom of the transfer blocks 68, 74, respectively.

The hydraulic cylinders are powered by a hydraulic system 108. The hydraulic system 108 can include customary components such as a pump, controls, lines, filter, and a reservoir. The hydraulic system is generally disposed above the water surface, but can be disposed at a subsea depth, if desired.

Some of the components of the transfer assembly 56 form a subassembly, nominated herein a mechanical interlock 58.

The mechanical interlock 58 can act and secure the transfer assembly 56 independently of the hydraulic cylinders 76A, 76B and the associated hydraulic system 108. In this embodiment, the mechanical interlock 58 could include, for example, the pulleys 72, 80 and the transfer leg 98, where at least one of the pulleys is an eccentric pulley. If one or more of the pulleys 70, 86 were also eccentric, then those pulleys could form at least part of the mechanical interlock 58.

When the one or more tether assemblies 65 are in place, the hydraulic cylinders 76 can be activated with the hydraulic system 108. The hydraulic rod 78 generally recedes into the hydraulic cylinder, pulling the transfer blocks 68, 74 closer to each other, and thereby pulling the buoyancy can 16 and the riser support connection 20 closer to each other. This movement causes the load to be transferred from the flexible link 18 to the one or more tether assemblies 65. The movement is designed to be sufficient to allow the flexible link 18 to become at least partially slack for repair or replacement. However, the hydraulic cylinders can leak or fail. The present invention further provides the mechanical interlock 58 described above that can lock at a length "B" shown in FIG. 5E between the transfer blocks 68, 74 independently of the hydraulic cylinders' ability to hold a reduced distance therebetween.

When the hydraulic cylinders 76 pull the transfer blocks 68, 74 closer together, the transfer leg 98 also becomes slack. The slack in the transfer leg 98 can be at least partially taken up by activating the mechanical interlock 58 by rotating one of more of the eccentric pulleys as described in FIGS. 5C, 5D. After the slack is taken up, the transfer blocks 68, 74 can be locked at a reduced length B, resulting in the buoyancy can 16 and riser support connection 20 being at a reduced distance, so that the flexible link 18 can be replaced or repaired.

Figure 5D:
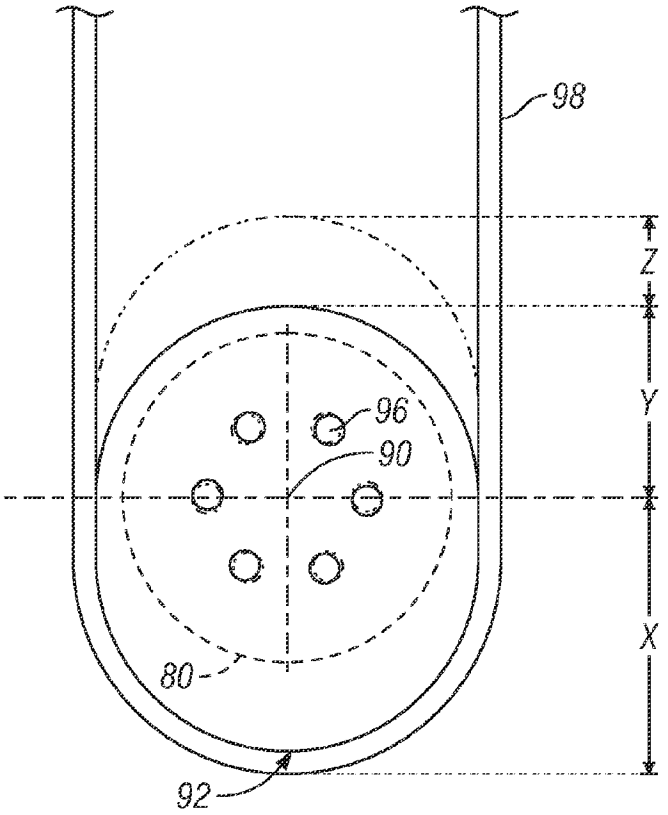
FIG. 5D is a schematic side view of the eccentric pulley of FIG. 5C in a second rotational position.
Figure 5C:
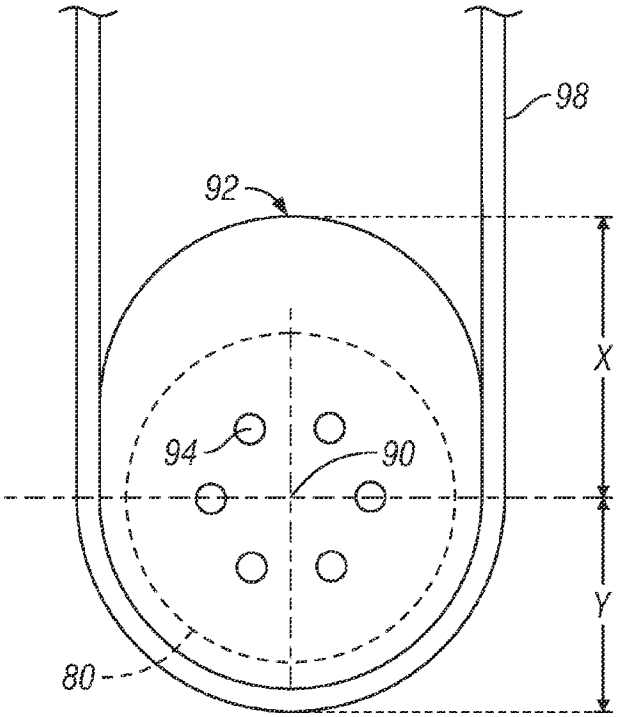
FIG. 5C is a schematic detail side view of a portion of a tether assembly having a transfer assembly with an eccentric pulley in a first rotational position.

FIG. 5C is a schematic detail side view of a portion of a tether assembly having a transfer assembly with an eccentric pulley in a first rotational position. FIG. 5D is a schematic side view of the eccentric pulley of FIG. 5C in a second rotational position. The figures will be described in conjunction with other. An initial position of the eccentric pulley, such as pulley 80, can orient the eccentric shape to allow maximum distance between the pulleys 72, 80. Therefore, in the embodiment shown, the maximum offset of the eccentric portion of the pulley surface 92 could advantageously be oriented toward the opposing pulley at the other end of the transfer leg 98, such as the pulley 72. Thus, a measurement from a rotational centerline 90 of the pulley 80 to the maximum eccentric offset of the pulley 80 in the direction of the opposing pulley 72 would establish a distance of "X". A measurement in the opposite direction would establish a distance of "Y", where X is greater than Y for the eccentricity. When the transfer leg 98 is slack and the pulley 80 is rotated in the opposite orientation, so that the eccentricity is disposed away from the opposing pulley 72, the orientations of the dimensions X, Y are reversed. The difference between X and Y establishes a dimension Z that is the difference in maximum allowable displacement between the pulleys 72, 80 and thus ultimately between the buoyancy can 16 and the riser support connection 20. Naturally, if other pulleys, such as pulley 72 on the opposite end of the transfer leg 98, and/or the pulleys 70, 86 are also formed with eccentric shapes, then the maximum displacement can be increased proportionately between the buoyancy can 16 and the riser connection 20 depending on the amount of eccentricities from the one or more pulleys.

To assist in rotating the pulley 80, one or more coupling elements 94 can be made in the pulleys to allow coupling of an ROV arm or other external mechanism to rotate the pulley 80 from one rotational position to another rotational position. Further, in some embodiments, the pulley 80 (or another eccentric pulley) can be operated prior to slack occurring in the transfer leg 98 (or the other slings if the other pulleys have eccentricities). Such movement would cause the same result as to move the displacement between the buoyancy can 16 and riser support connection 20 by dimension Z. When the pulley 80 is rotated in the position shown in FIG. 5D, the hydraulic cylinders 76 can be released, or alternatively, retain fluid pressure. However, the mechanical interlock 58 establishes a maximum length between the transfer blocks 68, 74 that is independent of the operation of the hydraulic cylinder 76. Thus, whether the hydraulic cylinders are activated or deactivated, the mechanical interlock provides a secure means for ensuring that the system stays at a fixed maximum length that is generally less than the original displacement, regardless of the operation of the hydraulic system, so that the flexible link 18 can be repaired or replaced.

Figure 5E:
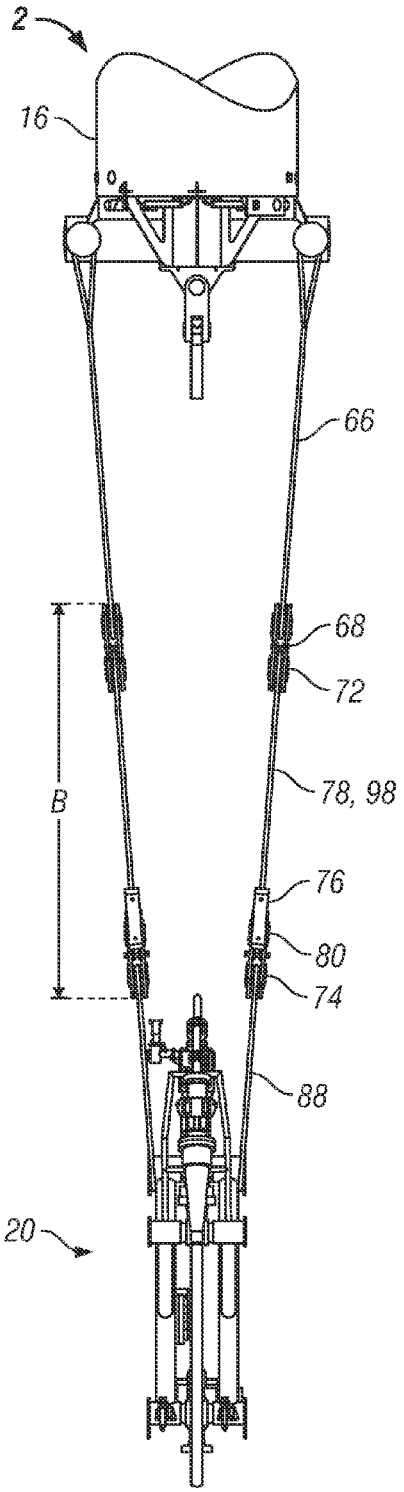
FIG. 5E is a schematic front view of the system of FIG. 5A with a mechanical interlock activated and the flexible link removed for replacement.

FIG. 5E is a schematic front view of the system of FIG. 5A with a mechanical interlock activated and the flexible link removed for replacement. With the mechanical interlock 58 activated, the maximum length of the transfer assembly 56 has been reduced to a length B, that is less than the length A shown in FIG. 5B. The system has locked the distance between the buoyancy can 16 and the riser support connection 20 due to the movement of the eccentric pulley or pulleys to a smaller length than the original length, allowing the flexible link 18 to securely remain slack for removal or repair. The system can further provide a lock (not shown) to assist the pulley to remain in the desired orientation.

Figure 5F:
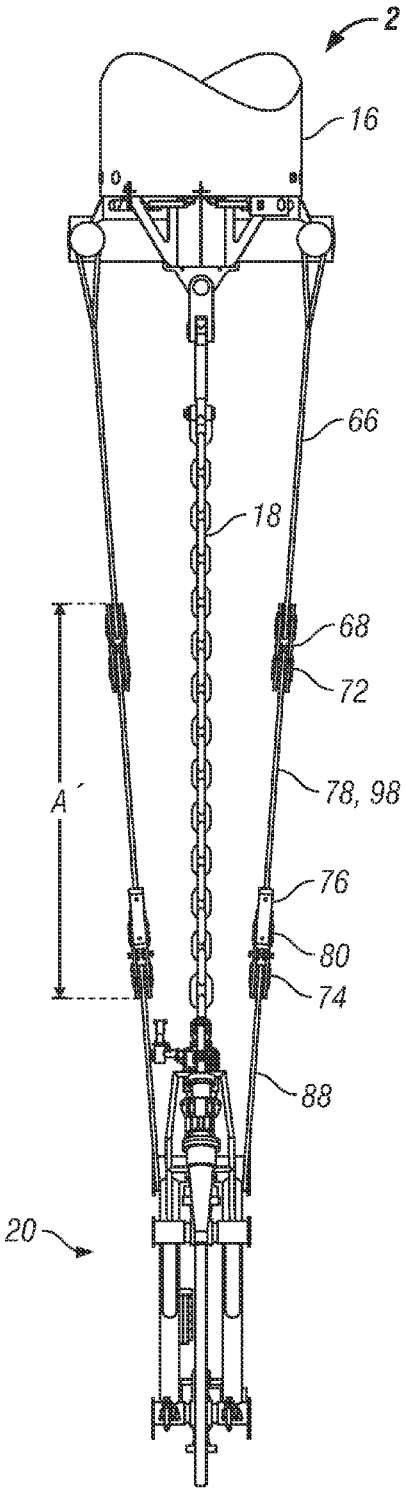
FIG. 5F is a schematic front view of the system of FIG. 5E with the mechanical interlock deactivated and the flexible link replaced.

FIG. 5F is a schematic front view of the system of FIG. 5E with the mechanical interlock deactivated and the flexible link replaced. After a replacement flexible link is installed or the original flexible link is repaired and reinstalled, the reverse process can be performed, so that the pulley 80 (or other pulleys if eccentrically formed) can be rotated from the position shown in FIG. 5D to the position shown in FIG. 5C. The hydraulic cylinders can be extended, if necessary, so that the system can return to some deactivated length A' of the transfer assembly 56, which may be equal to the original length A and in any case will be greater than the length B during the mechanical interlock activation.

Figure 6A:
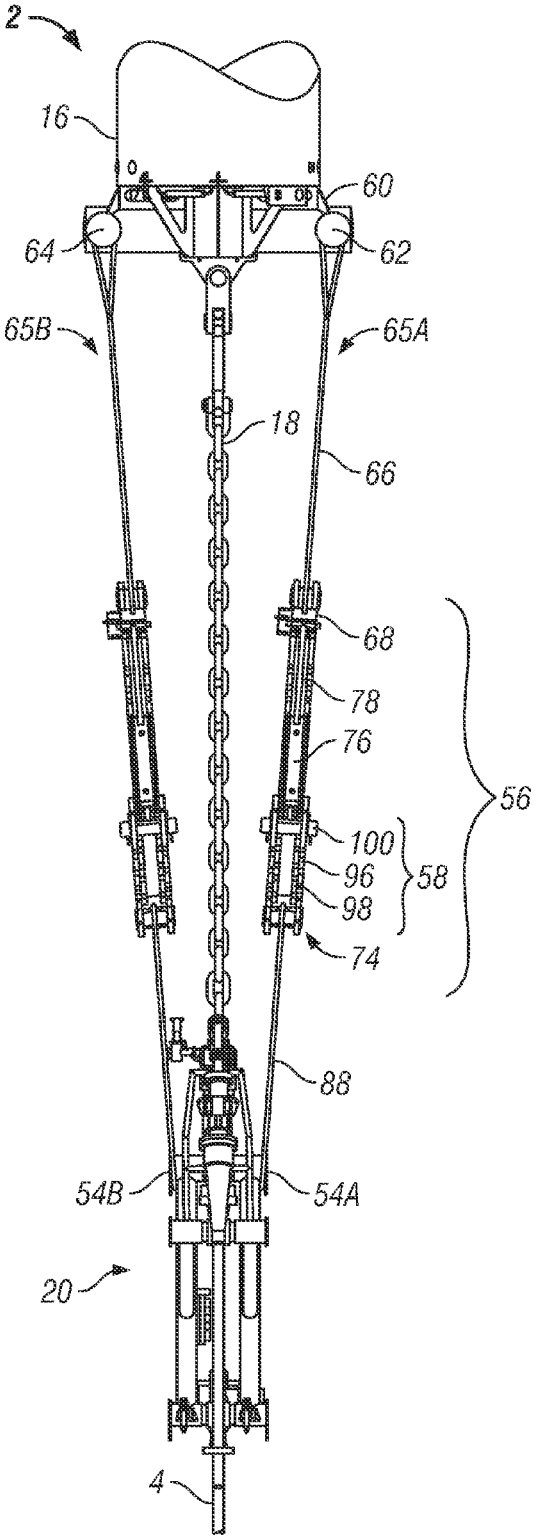
FIG. 6A is a schematic front view of an exemplary tether assembly with another transfer assembly.
Figure 6B:
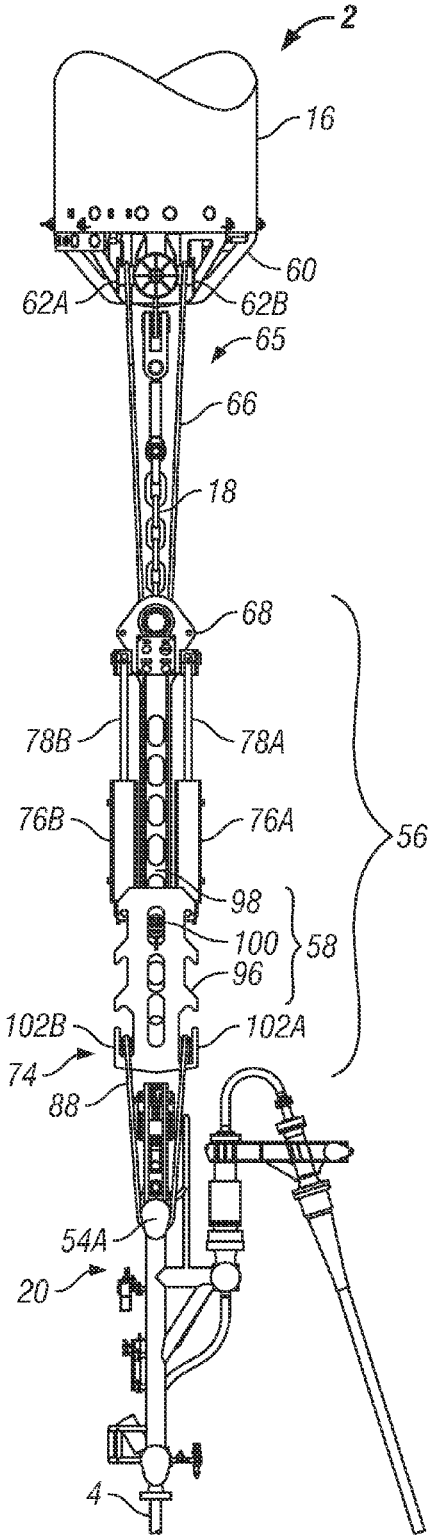
FIG. 6B is a schematic side view of the system in FIG. 6A with the tether assembly.

FIG. 6A is a schematic front view of an exemplary tether assembly with another transfer assembly. FIG. 6B is a schematic side view of the system in FIG. 6A with the tether assembly. The figures will be described in conjunction with other. The system 2 for present purposes is similar to the above embodiment of FIGS. 5A-5F, but with a different embodiment for the transfer assembly 56. As described above, the buoyancy can 16 can include the lug frame 60 having generally a plurality of lugs 62, 64. One of more tether assemblies 65, such as assemblies 65A, 65B, can be coupled between the lugs 62, 64 on the lug frame 60 of the buoyancy can 16 and the lugs 54A, 54B on the riser support connection 20. The transfer assembly 56 generally includes a transfer block 68 and a mechanical interlock 58 having a pin adjustable assembly with one or more lugs 102A, 102B, which effectively forms another embodiment of the transfer block 74 referenced in the above embodiment. The mechanical interlock 58 in this embodiment is formed by the slidable interaction between a receptacle 96 on the transfer block 74 and a transfer leg 98 coupled to the transfer block 68, where the transfer leg is slidably disposed within the receptacle and can be pinned at different lengths into a mechanically locked position. A removable pin 100 as a coupler can be disposed at various locations as holes in each of the transfer leg and receptacle are aligned to allow the pin to be inserted therethrough. The lower transfer block 74 includes a transfer lug 102, so that the sling 88 can be coupled between the transfer lug 102 and the lug 54A on the riser support connection 20. In the illustrated embodiment, there are two transfer lugs, 102A and 102B on which the ends of the sling 88 are attached with the middle portion of the sling wrapped around the riser connection lug 54A.

As a general statement of operation, the cylinders 76A, 76B are activated to pull their respective rods 78A, 78B into a recessed position within the cylinder, thereby reducing the length of the transfer assembly 56. When the link is reduced to a suitable amount, the pin 100 can be inserted into an appropriate hole in the receptacle 96 that is aligned with a corresponding hole in the transfer leg 98. Once the pin 100 is installed, the hydraulic cylinder 76 can be deactivated if desired, because the transfer assembly 56 has been locked into a maximum length by the activation of the mechanical interlock 58. In this position, the flexible link 18 has become slack while the load and tension between the buoyancy can 16 and the riser support connection 20 has been transferred to the one or more tether assemblies 65 coupled therebetween.

Figure 6E:
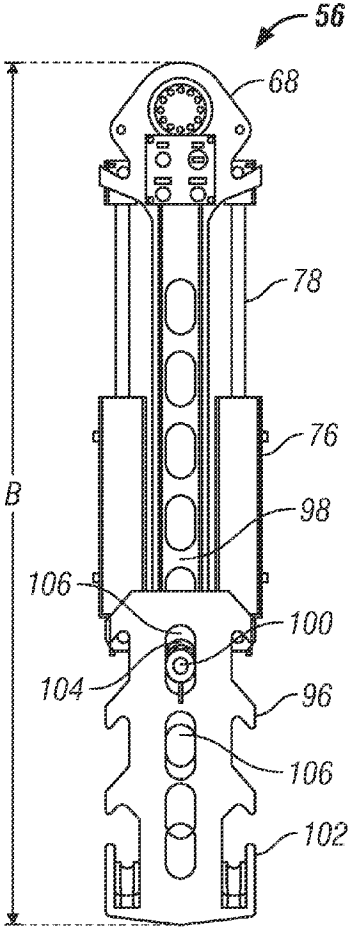
FIG. 6E is a schematic side view of the transfer assembly of FIG. 6C in a second position with a mechanical interlock for in-situ transfer for the load on the flexible link.
Figure 6D:
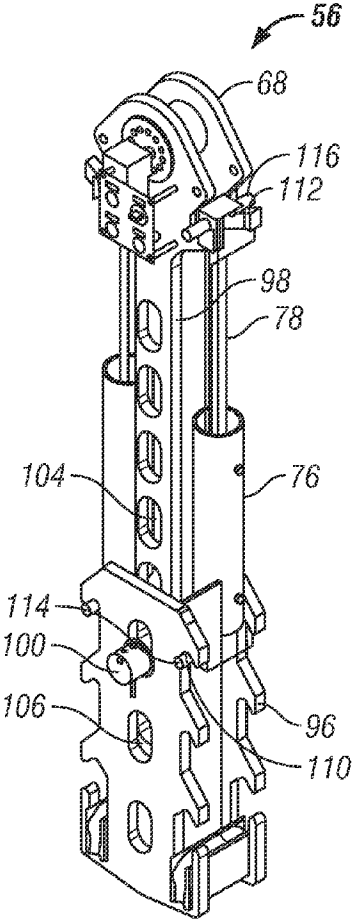
FIG. 6D is a schematic perspective view of the transfer assembly of FIG. 6C in the first position.
Figure 6C:
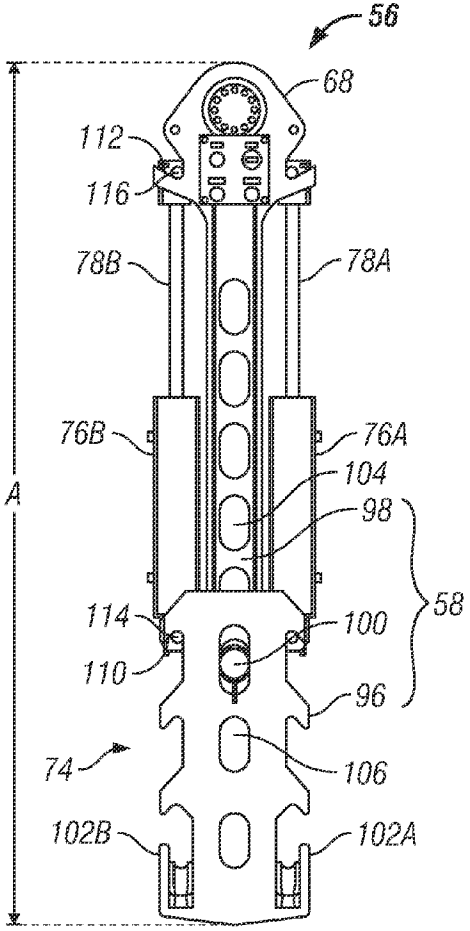
FIG. 6C is a schematic side detail view of a portion of the tether assembly of FIG. 6B, illustrating the transfer assembly in a first position with a mechanical interlock.

FIG. 6C is a schematic side detail view of a portion of the tether assembly of FIG. 6B, illustrating the transfer assembly in a first position with a mechanical interlock 58. FIG. 6D is a schematic perspective view of the transfer assembly of FIG. 6C in the first position. The figures will be described in conjunction with each other. The transfer assembly 56 generally includes the transfer block 68 to which the sling 66 can be coupled, as shown in FIGS. 6A, 6B. The transfer block 68 is coupled to the transfer leg 98 which slidably engages the receptacle 96, distally from the transfer box 68. The sling 88, described above, can be coupled between the lug 54A on the riser support connection 20 and the lower portion of the transfer assembly 56 that includes a transfer lugs 102A, 102B. The receptacle 96 and the lug 102 form a transfer block 74. The transfer leg 98 includes one of more leg openings 104. Similarly, the receptacle 96 includes one or more receptacle openings 106. The pin 100 is removable and can be inserted through sets of aligned openings 104, 106 for mechanically interlocking the assembly. The transfer assembly 56 defines an initial length A between the transfer blocks 68, 74 prior to cylinder activation.

A feature that is described in this embodiment, but also used on other embodiments herein is a quick disconnect for the hydraulic cylinders 76 and their rods 78 from the transfer assembly 56. For example, the receptacle 96 can include a recess 110 that is formed in an outward portion of the receptacle with an opening facing away from the transfer assembly 56. The recess 110 provides an open recess that allows free movement of an object in and out of the recess. Similarly, the transfer block 68 can be formed with a recess 112 with an opening that is facing away from the transfer assembly 56 in an opposite direction to the recess 110. The hydraulic cylinder 76 can be removably coupled with a pin or other coupler 114 in the recess 110. Similarly, the rod 78 can be removably coupled with a pin or other coupler 116 in the recess 112. In operation, the cylinders can be inserted into their respective recesses and the rods inserted in their respective recesses for easy assembly and disassembly to the transfer assembly 56.

FIG. 6E is a schematic side view of the transfer assembly of FIG. 6C in a second position with a mechanical interlock for in-situ transfer for the load on the flexible link. As a general statement of operation, the cylinders 76A, 76B are activated and pull their rods 78A, 78B into a withdrawn position in the cylinders, thereby reducing the length of the transfer assembly 56 from the initial length A. The movement of the hydraulic cylinders 76 causes the transfer leg 98 to be slide relative to the receptacle 96. When the length of the transfer assembly is reduced to a length B of a suitable amount, the pin 100 can be inserted into an appropriate opening 106 in the receptacle 96 that is aligned with a corresponding opening 104 in the transfer leg 98.

Figure 6F:
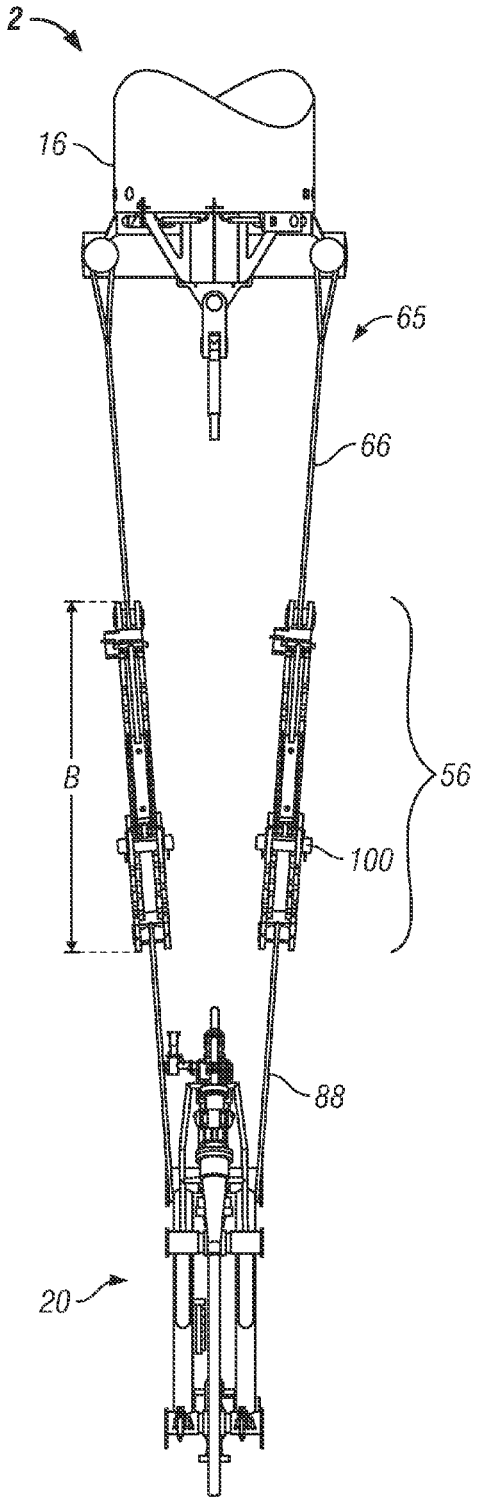
FIG. 6F is a schematic front view of the tether assembly and system of FIG. 6A with a mechanical interlock activated and the flexible link removed for replacement.

FIG. 6F is a schematic front view of the tether assembly and system of FIG. 6A with a mechanical interlock activated and the flexible link removed for replacement. Once the pin 100 is installed, the hydraulic cylinders 76 can be deactivated, if desired, because the transfer assembly 56 has been locked into a maximum length B by the activation of the mechanical interlock 58 independent of the hydraulic cylinder operations. In this position, the flexible link 18 has become slack, because the tether assembly 65, through operation of the transfer assembly 56, has shortened the distance between buoyancy can 16 and riser support connection 20. The flexible link 18 can be removed and repaired or replaced, while the load between the buoyancy can 16 and the riser support connection 20 is transferred to the one or more mechanically locked tether assemblies 65 coupled therebetween.

Figure 6G:
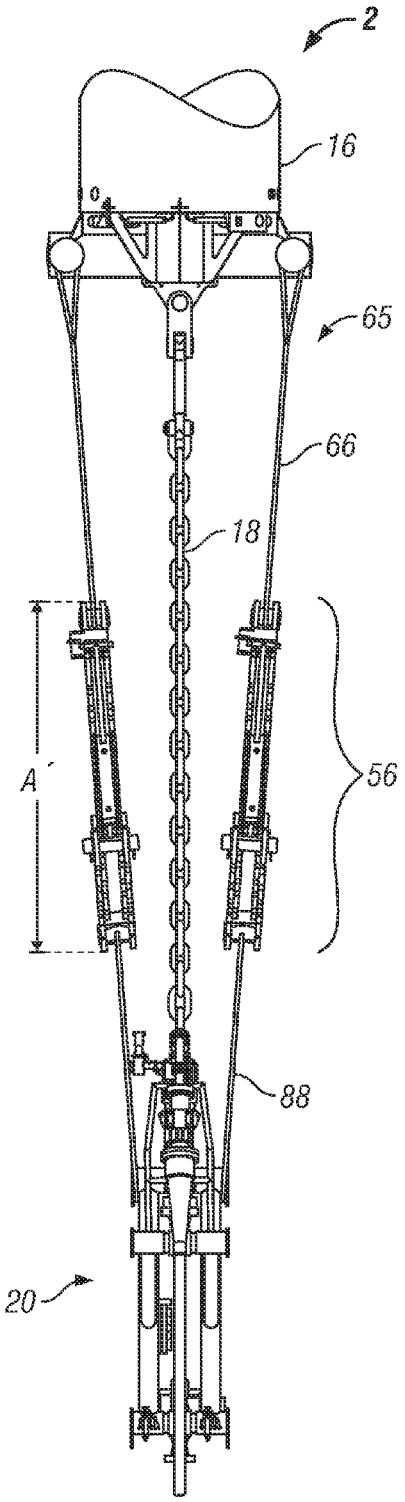
FIG. 6G is a schematic front view of the tether assembly and the system of FIG. 6F with the mechanical interlock deactivated and the flexible link replaced.

FIG. 6G is a schematic front view of the tether assembly and the system of FIG. 6F with the mechanical interlock deactivated and the flexible link replaced. After the flexible link 18 has been replaced or reinserted and coupled between the buoyancy can 16 and the riser support connection 20, the pin 100 can be removed and the length of the transfer assembly 56 can be extended to A', which may be the same as the original length A. The extended length A' of the tether assembly is greater than the length B and is sufficient to retransfer the tensile load onto the flexible link 18. The tether assembly 65 can become slack and can be removed or can remain in position for future possible operations.

Figure 7A:
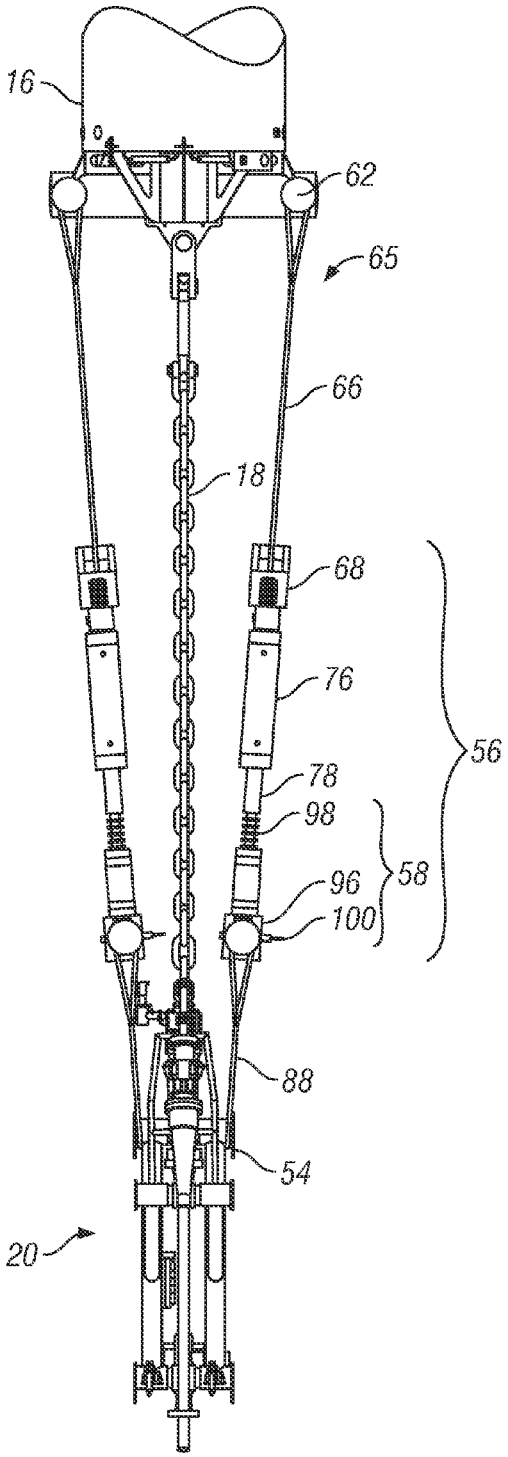
FIG. 7A is a schematic front view of an exemplary tether assembly with another transfer assembly.
Figure 7B:
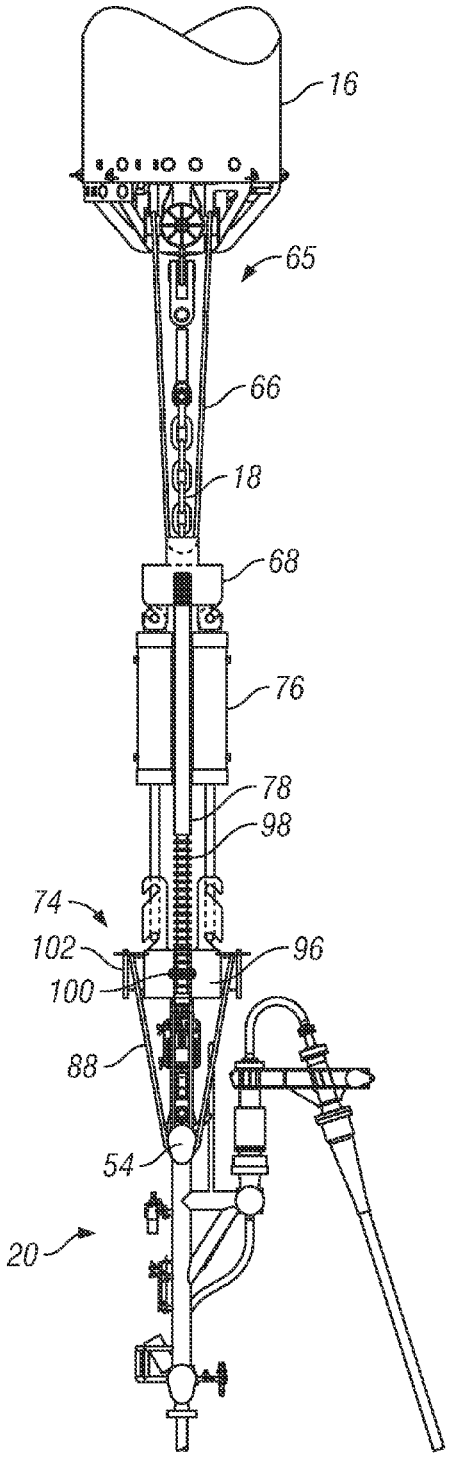
FIG. 7B is a schematic side view of the system in FIG. 7A with the tether assembly.
Figure 7E:
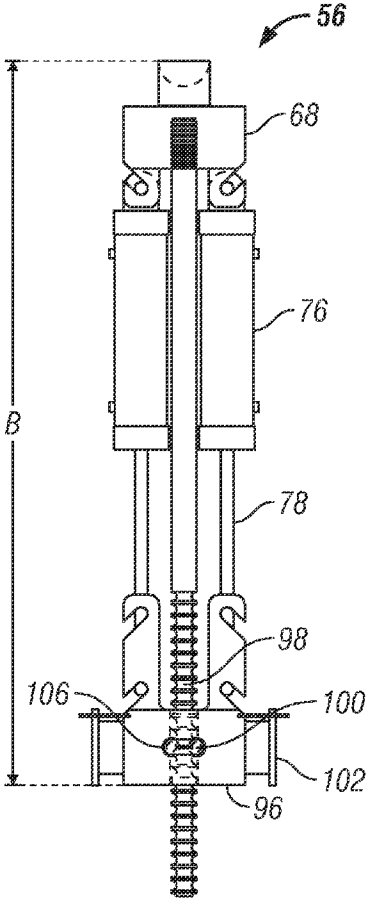
FIG. 7E is a schematic side view of the transfer assembly of FIG. 7C in a second position with a mechanical interlock for in-situ transfer for the load on the flexible link.
Figure 7D:
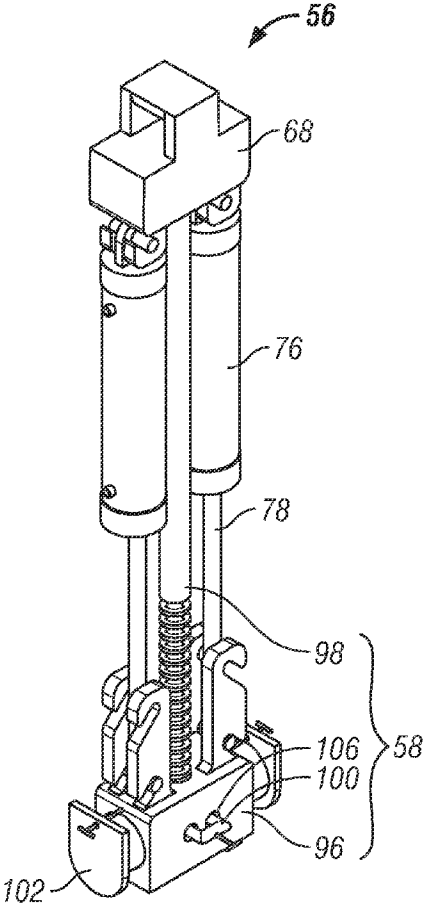
FIG. 7D is a schematic perspective view of the transfer assembly of FIG. 7C in the first position.
Figure 7C:
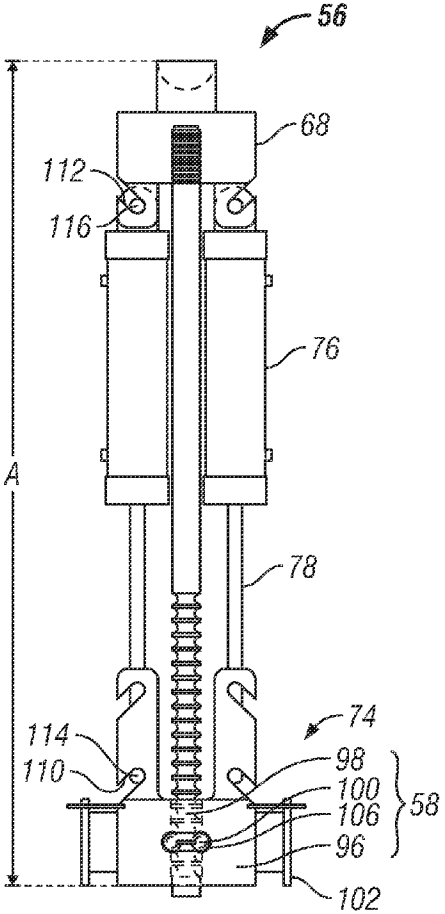
FIG. 7C is a schematic side detail view of a portion of the tether assembly of FIG. 7B, illustrating the transfer assembly in a first position with a mechanical interlock.
Figure 7F:
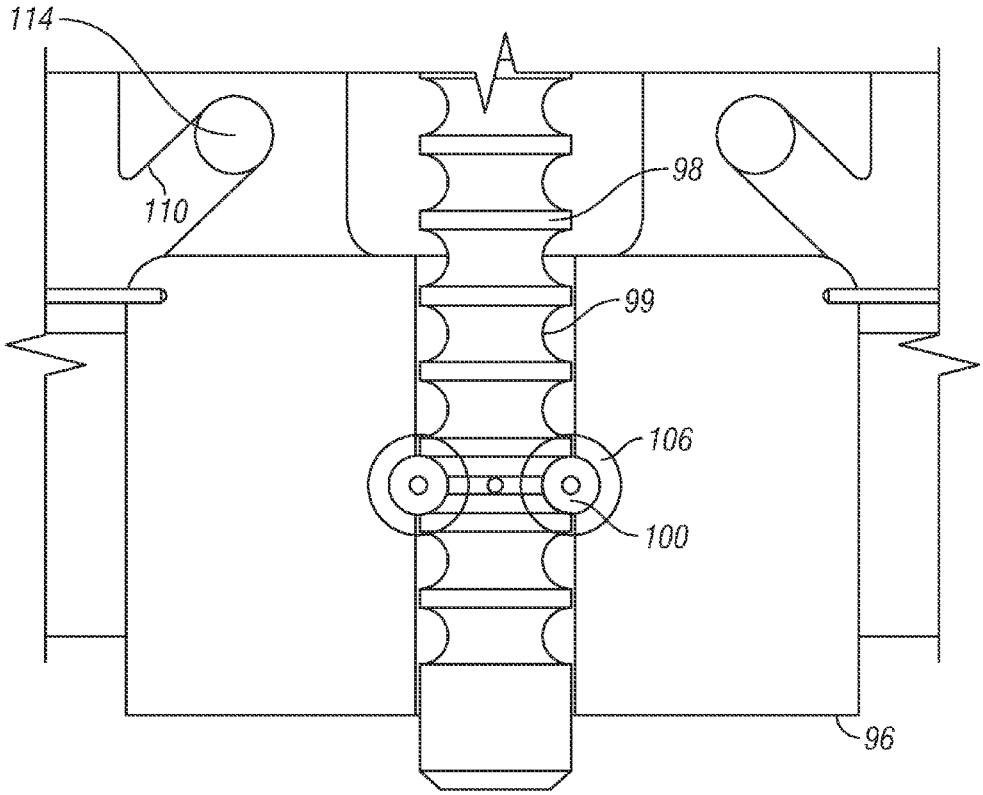
FIG. 7F is a schematic side detail view of the mechanical interlock of the transfer assembly of FIG. 7C.

FIG. 7A is a schematic front view of an exemplary tether assembly with another transfer assembly. FIG. 7B is a schematic side view of the system in FIG. 7A with the tether assembly. FIG. 7C is a schematic side detail view of a portion of the tether assembly of FIG. 7B, illustrating the transfer assembly in a first position with a mechanical interlock. FIG. 7D is a schematic perspective view of the transfer assembly of FIG. 7C in the first position. FIG. 7E is a schematic side view of the transfer assembly of FIG. 7C in a second position with a mechanical interlock for in-situ transfer for the load on the flexible link. FIG. 7F is a schematic side detail view of the mechanical interlock of the transfer assembly of FIG. 7C. The figures will be described in conjunction with other.

The tether assembly 65 can be coupled between the lug 62 on the buoyancy can 16 and the lug 54 on the riser support connection 20, when the flexible link 18 requires replacement or repair. The tether assembly 65 can include one or more slings 66, 88 and a transfer assembly 56. The transfer assembly 56 generally includes a transfer block 68 that is coupled to the sling 66 on one end and a second transfer block 74 that is coupled to the sling 88 and distally located from the first transfer block 68. One or more hydraulic cylinders 76 and their rods 78 are coupled between the transfer blocks 68, 74. The hydraulic cylinders and their rods can be removably coupled between a recess 110 on the receptacle 96 of the transfer block 74 and a recess 112 on the transfer block 68 as described above. A transfer leg 98 can be coupled to the transfer block 68. The receptacle 96 can have an opening therethrough that allows the transfer leg 98 to slide through the receptacle 96 when the hydraulic cylinders 76 are activated and change the length of the transfer assembly 56 from a first length A to a reduced length B. A receptacle opening 106 is disposed at least partially through the receptacle 96. The receptacle opening 106 is configured to allow a pin 100 to be inserted therethrough. As the detail in FIG. 7F shows, the pin 100 can be shaped in a fork with two or more prongs that can be inserted through receptacle openings 106 and sized to engage an appropriate groove 99 on the transfer leg 98. Thus, when the pin 100 is inserted through the opening 106, the pin engages the smaller diameter groove 99 of the transfer leg 98 to lock the transfer leg in a given longitudinal position relative to the receptacle 96.

In operation, when the flexible link 18 needs repair or replacement, the tether assembly 65 can be coupled between the buoyancy can 16 and the riser support connection 20 using the lugs 62, 64. After installation, the tether assembly can be tensioned and the hydraulic cylinders activated with the pin 100 removed to reduce a maximum distance between the buoyancy can 16 and the riser support connection 20. Thus, the maximum length of the transfer assembly 56 is reduced from the length A in the first position to the reduced length B in a second position after the cylinder has shortened the length of the transfer assembly 56. The pin 100 is then placed in the opening 106 after the cylinders have reduced the length to length B. Thus, at that point, hydraulic cylinders can be deactivated, while the transfer assembly is mechanically interlocked by the pin 100 interacting with the receptacle 96 and the transfer leg 98.

As described in prior embodiments, the flexible link 18 becomes slack when the transfer assembly 56 is the reduced to length B. The slack allows the flexible link 18 to be removed and replaced, or repaired and reinserted. After replacement or reinsertion, the pin 100 can be removed by reactivating the hydraulic cylinders to remove the load from the pin. The hydraulic cylinders can be deactivated, or if desired activated in the opposite direction, to lengthen the transfer assembly 56. Once lengthened, tension is reapplied to the flexible link 18 between the buoyancy can 16 and the riser support connection 20. With the tension applied to the flexible link 18, the tensile load is removed from the tether assembly 65. The tether assembly 65 can then be removed, if desired, and the floatation system can resume normal operational status.

Figure 8A:
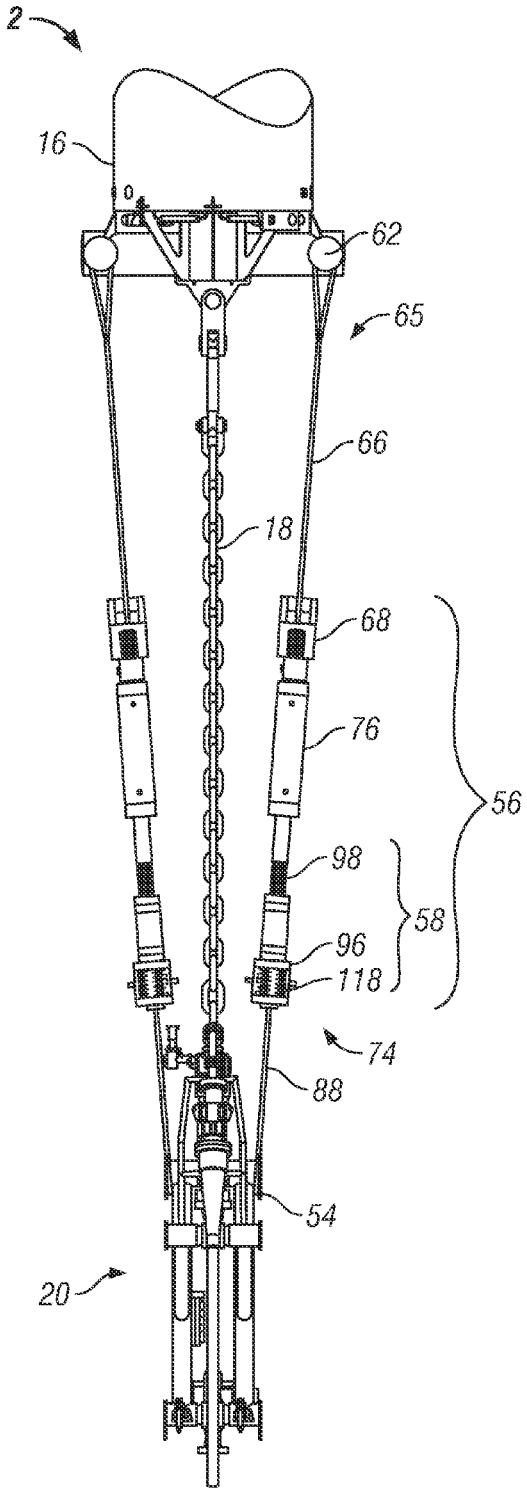
FIG. 8A is a schematic front view of an exemplary tether assembly with another transfer assembly.
Figure 8B:
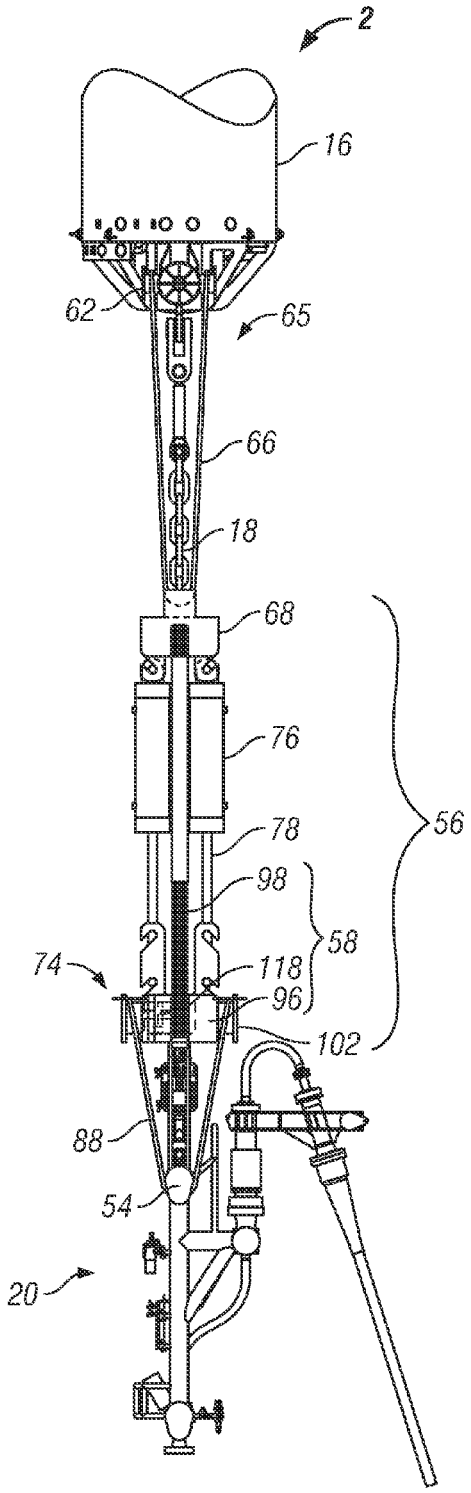
FIG. 8B is a schematic side view of the system in FIG. 8A with the tether assembly.
Figure 8E:
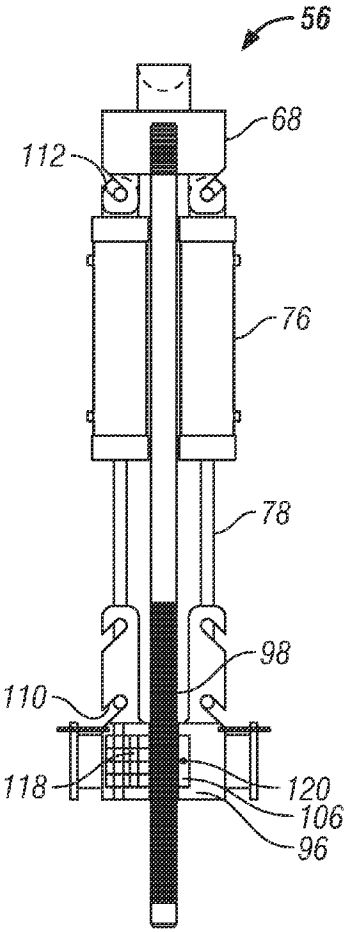
FIG. 8E is a schematic side view of the transfer assembly of FIG. 8C in a second position with a mechanical interlock for in-situ transfer for the load on the flexible link.
Figure 8D:
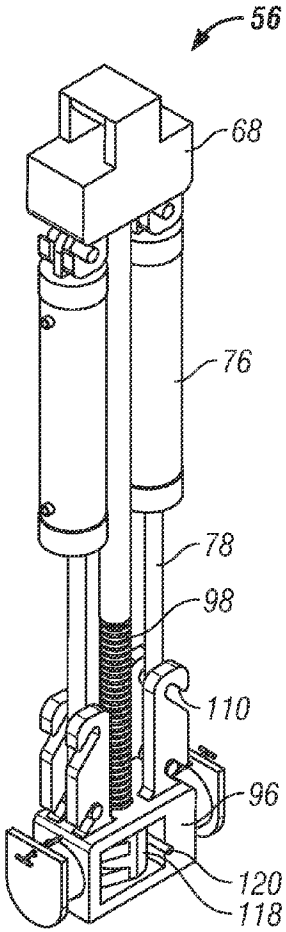
FIG. 8D is a schematic perspective view of the transfer assembly of FIG. 8C in the first position.
Figure 8C:
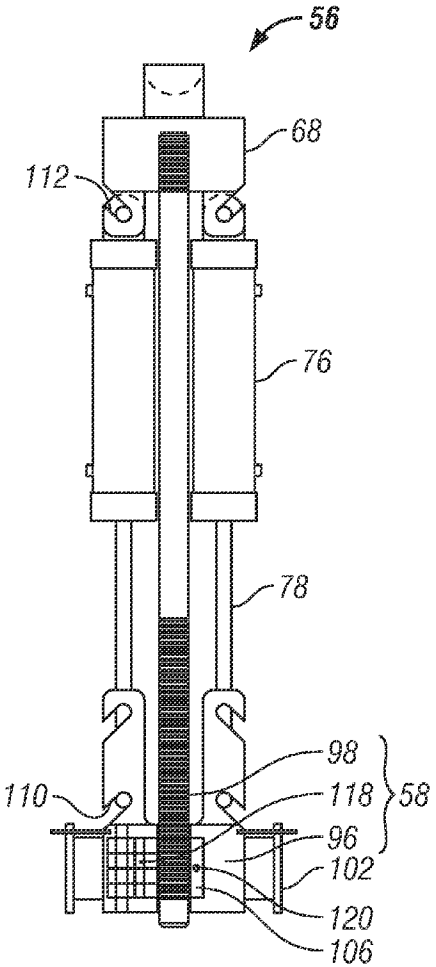
FIG. 8C is a schematic side detail view of a portion of the tether assembly of FIG. 8B, illustrating the transfer assembly in a first position with a mechanical interlock.
Figure 8F:
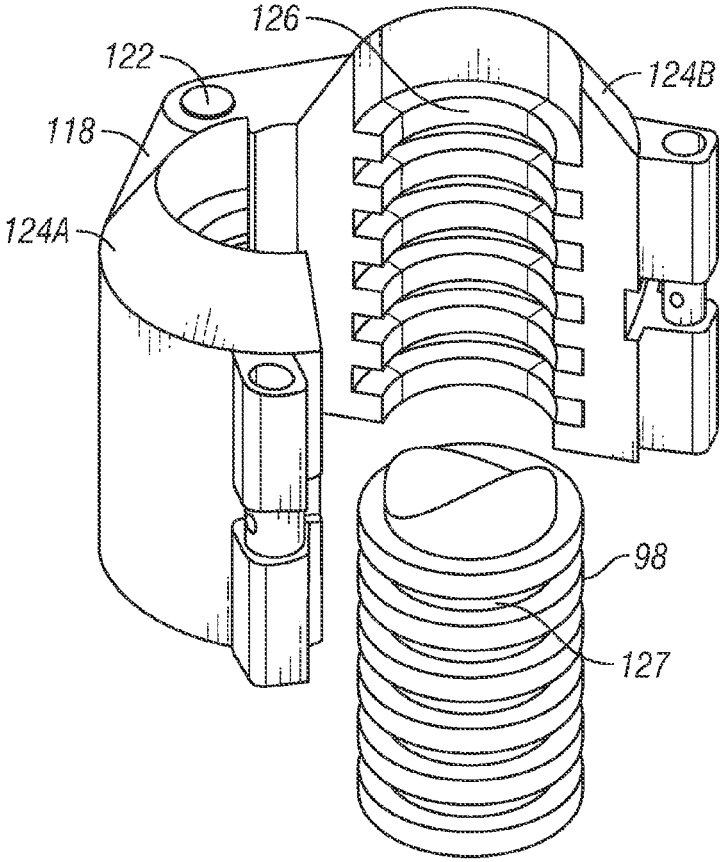
FIG. 8F is a schematic perspective detail view of a clamshell of the mechanical interlock of the transfer assembly of FIG. 8C in a deactivated (open) position.
Figure 8G:
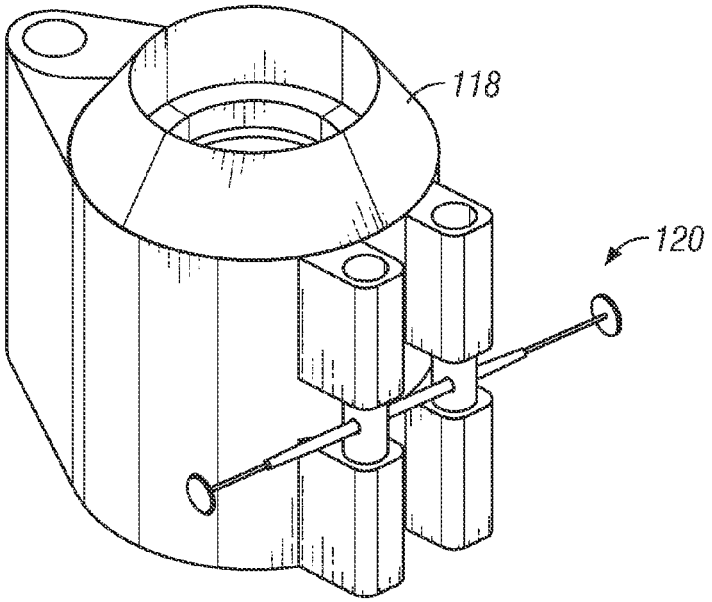
FIG. 8G is a schematic perspective detail view of the clamshell of FIG. 8F in an activated (closed) position.

FIG. 8A is a schematic front view of an exemplary tether assembly with another transfer assembly. FIG. 8B is a schematic side view of the system in FIG. 8A with the tether assembly. FIG. 8C is a schematic side detail view of a portion of the tether assembly of FIG. 8B, illustrating the transfer assembly in a first position with a mechanical interlock. FIG. 8D is a schematic perspective view of the transfer assembly of FIG. 8C in the first position. FIG. 8E is a schematic side view of the transfer assembly of FIG. 8C in a second position with a mechanical interlock for in-situ transfer for the load on the flexible link. FIG. 8F is a schematic perspective detail view of a clamshell of the mechanical interlock of the transfer assembly of FIG. 8C in a deactivated (open) position. FIG. 8G is a schematic perspective detail view of the clamshell of FIG. 8F in an activated (closed) position. The figures will be described in conjunction with other.

The floatation system 2 shown in FIGS. 8A-8G show an alternative embodiment of the tether assembly with an alternative mechanical interlock 58. In general, the buoyancy can 16 is coupled to the riser support connection 20 through the flexible link 18. When the flexible link 18 needs replacement or repair, the tether assembly 65 can be coupled between the buoyancy can 16 and the riser support connection 20, such as by using lugs 62, 54. The tether assembly 65 generally includes one or more slings 66, 88 with a transfer assembly 56. The transfer assembly 56 can include a transfer block 68 and a transfer block 74. The transfer assembly 56 further includes at least one hydraulic cylinder 76 with its associated rod 78 that is coupled between the transfer blocks 68, 74. The cylinder 76 and its associated rod 78 can be releasably quick coupled to the transfer block 68 by sliding it into a recess 112. Similarly, the cylinder and associated rod can be quick coupled to the transfer block 74 at the receptacle 96 by the recess 110. A transfer leg 98 is coupled to the transfer block 68 and slidably coupled to the transfer block 74 through the receptacle 96.

The transfer block 74 generally includes subcomponents such as a receptacle 96 that is slidably coupled with a transfer leg 98, a releasable clamshell 118 as a coupler for coupling the transfer leg to the receptacle described below, and a lug 102 for coupling the sling 88 to the riser support connection 20. An opening 106 in the receptacle 96 provides a supporting surface for mounting the clamshell 118. The clamshell 118 can releasably engage grooves 127 on the transfer leg 98. The combination of the transfer leg 98 with the clamshell 118 located in the opening 106 of the receptacle 96 or otherwise coupled thereto forms the mechanical interlock 58 of this embodiment. It is understood that the arrangement of the clamshell, transfer leg, and receptacle could be altered, so that clamshell could be connected to the transfer leg and selectively engage a portion of the receptacle to vary the length of engagement with the transfer leg.

When the tether assembly 65 is installed on the floatation system, the transfer assembly 56 has an initial length A. As shown in FIGS. 8F, 8G, the clamshell generally includes a first portion 124A and a second portion 124B that are hingeably coupled with a hinge 122. An inner surface of the clamshell includes a rib 126. The rib 126 can engage one or more corresponding grooves 127 on the transfer leg 98 when the clamshell is tightened around the transfer leg. A clamshell fastener 120 can be used to close the clamshell around the transfer leg 98 and thereby activate the mechanical interlock 58. The clamshell fastener 120 can be manual or powered and can include threads that can be rotatably turned to close and open the clamshell, a tapered pin that can be driven to close the clamshell, and other means of closure as would be known to those with ordinary skill in the art.

In operation, when the transfer assembly 56 is in a first position having a length A, the clamshell 118 can be in an open position, such as shown in FIG. 8F. The hydraulic cylinder 76 can be activated to withdraw the rods 78 therein to decrease the length of the transfer assembly 56 to a length B shown in FIG. 8E. The clamshell 118 can be activated by tightening the clamshell fastener 120, so that it closes around the transfer leg 98 and mechanically interlocks the system independent of the operation of the hydraulic cylinder 76.

As described in prior embodiments, the flexible link 18 can be removed and replaced, or repaired and reinstalled, while the mechanical interlock 58 is activated. After replacement or reinstatement, the clamshell 118 can be deactivated thereby deactivating the mechanical interlock 58 and releasing the system. If required, the hydraulic cylinders can be activated in the opposite direction to push out the hydraulic rods 78 and extend the length of the transfer assembly 56. The load on the tether assembly 65 can thereby be transferred to the flexible length 18 and the tether assembly 65 removed, if desired, as the floatation system can resume normal operational status.

The three remaining illustrative embodiments of a transfer assembly are variations of some of the above-described embodiments that further include shims. In general, the shims are used to further restrict the amount of movement of the mechanical interlock 58 and take up free space that might otherwise allow some degree of movement with the mechanical interlock 58. Further, the shims can be used to adjust the load by small amounts on the transfer assembly and thus the tether assembly. Stated differently, the above described systems can provide macro adjustment for the length of the transfer assembly 56, while the shims can provide micro adjustment for the length of the transfer assembly. Other embodiments using the principles described herein are contemplated.

Figure 9A:
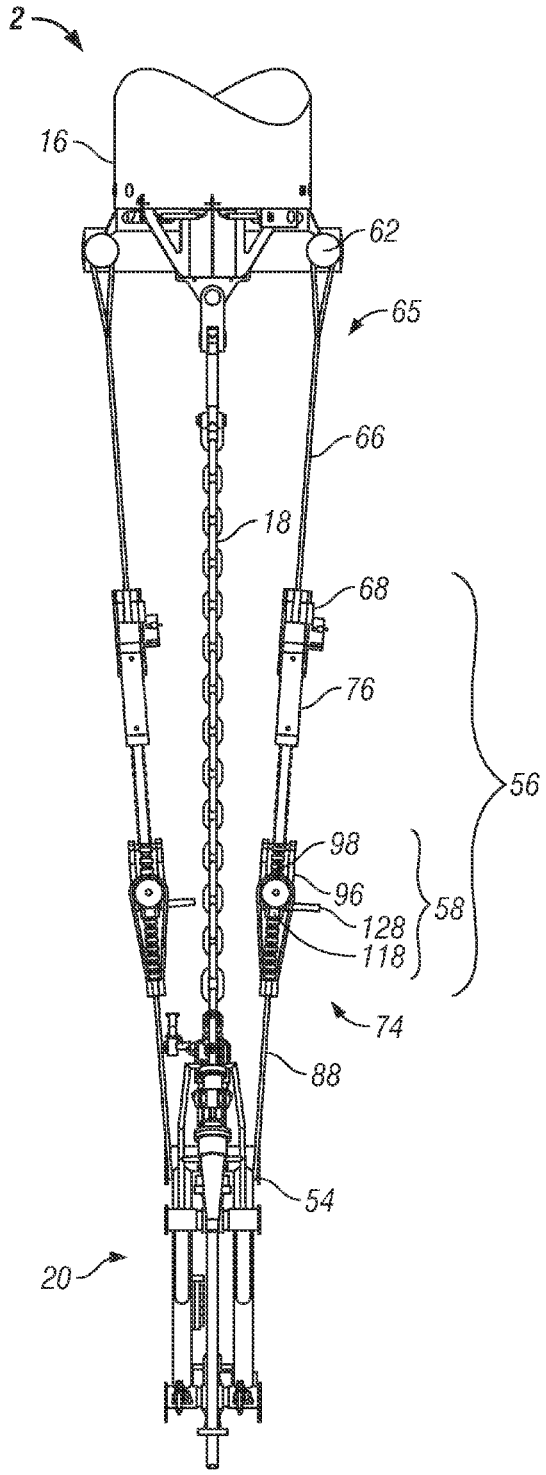
FIG. 9A is a schematic front view of an exemplary tether assembly with another transfer assembly.
Figure 9B:
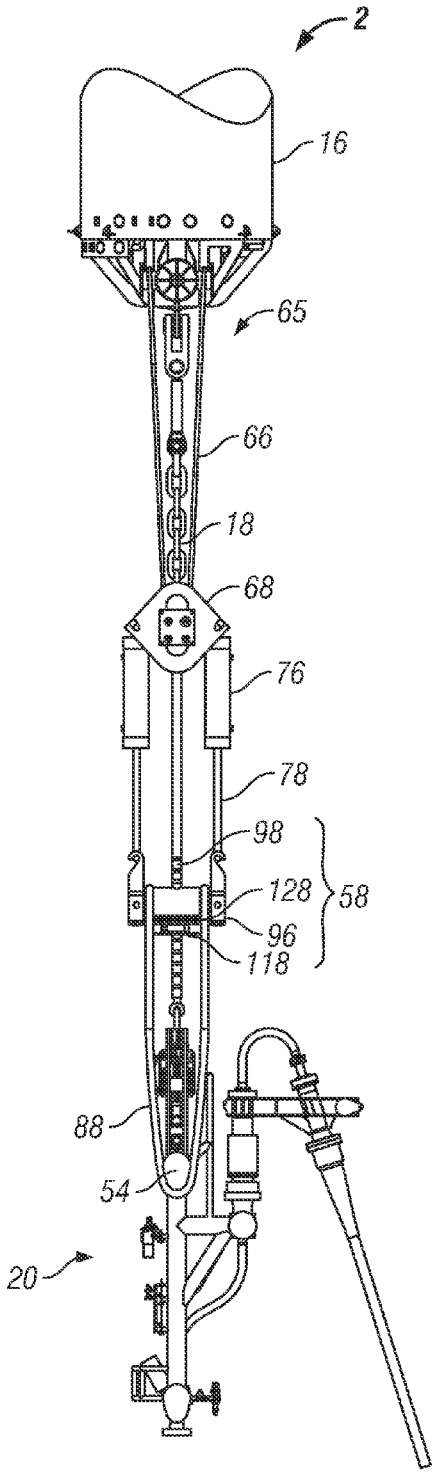
FIG. 9B is a schematic side view of the system in FIG. 9A with the tether assembly.
Figure 9E:
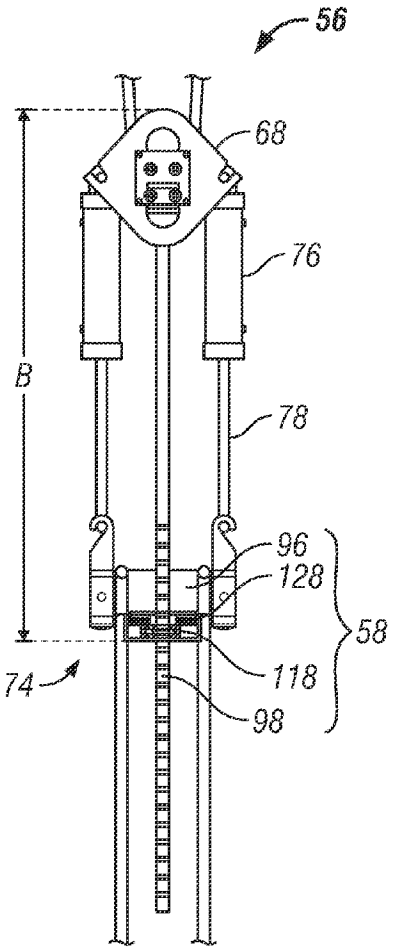
FIG. 9E is a schematic side view of the transfer assembly of FIG. 9C in a second position with a mechanical interlock for in-situ transfer for the load from the flexible link.
Figure 9D:
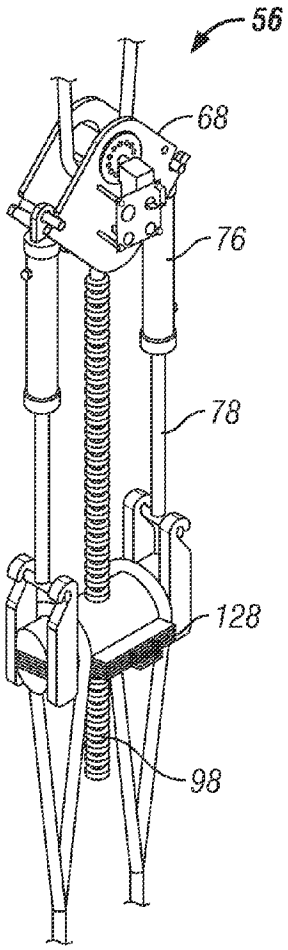
FIG. 9D is a schematic perspective view of the transfer assembly of FIG. 9C in the first position.
Figure 9C:
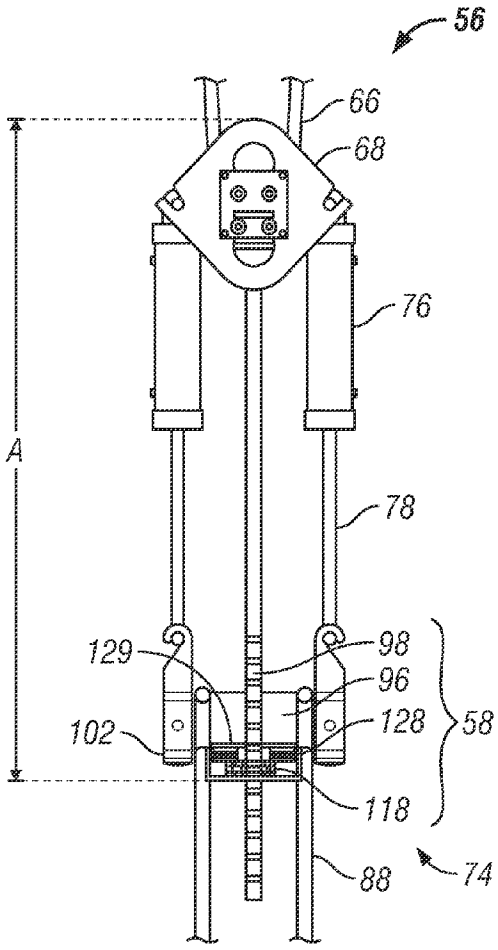
FIG. 9C is a schematic side detail view of a portion of the tether assembly of FIG. 9B, illustrating the transfer assembly in a first position with a mechanical interlock.
Figure 9F:
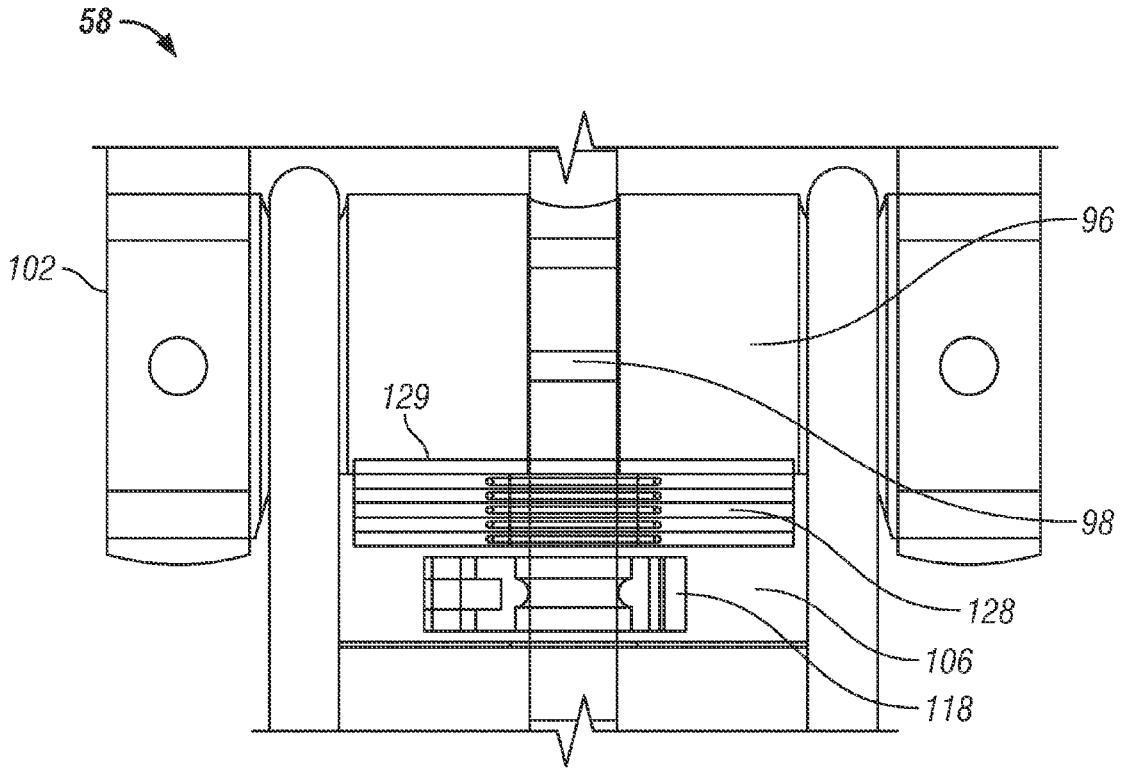
FIG. 9F is a schematic side detail view of the mechanical interlock of the transfer assembly of FIG. 9C.

FIG. 9A is a schematic front view of an exemplary tether assembly with another transfer assembly. FIG. 9B is a schematic side view of the system in FIG. 9A with the tether assembly. FIG. 9C is a schematic side detail view of a portion of the tether assembly of FIG. 9B, illustrating the transfer assembly in a first position with a mechanical interlock. FIG. 9D is a schematic perspective view of the transfer assembly of FIG. 9C in the first position. FIG. 9E is a schematic side view of the transfer assembly of FIG. 9C in a second position with a mechanical interlock for in-situ transfer for the load from the flexible link. FIG. 9F is a schematic side detail view of the mechanical interlock of the transfer assembly of FIG. 9C. The figures will be described in conjunction with other.

The floatation system 2, as described above, includes the buoyancy can 16 coupled to the riser support connect 20 through a flexible link 18. When a load is desired to be transferred from the flexible link 18, a tether assembly 65 can be coupled between buoyancy can 16 and the riser connection 20 through the use of lugs 62, 64. The tether assembly, in at least one embodiment, can include a sling 66 coupled between the lug 62 and a transfer assembly 66 on one end. A sling 88 can be coupled to an opposite end of the transfer assembly 56 and to the transfer lug 54 on the riser support connection 20. The transfer assembly 56 can include a transfer block 68 on one end and transfer block 74 on a distal end with hydraulic cylinders 76 and their associated rods 78 coupled therebetween. The transfer block 74 can include a receptacle 96 with a clamshell 118 coupled thereto, such as described above.

A mechanical interlock 58 subassembly can be formed from the receptacle 96 and the transfer leg 98 that can be coupled to the receptacle 96 through the clamshell 118 and any shims 128 inserted therein. In general, one of more shims 128 can be inserted between the clamshell 118 and a supporting surface 129 on the receptacle 96. The shims can be used to take up any slack in the movement between the grooves 127 on the transfer leg 98 (shown in FIG. 8F) and the clamshell 118.

The transfer assembly 56 can have a length A in a first position. The hydraulic cylinders can be activated when the clamshell 118 is deactivated and in an open position. The transfer leg 98 can slidably extend through the receptacle 96 until the hydraulic cylinder 76 stops movement of its associated rod 78 to establish a reduced length B for the transfer assembly 56 in a second position. The clamshell 118 can be activated to a closed position around the transfer leg 98 in grooves 127, as described above. The shims 128 can be inserted by means of an ROV or other available means of insertion. When the mechanical interlock 58 has been activated with the clamshell 118 and shims 128, and the transfer assembly 56 is at a reduced length B, the load has been transferred to the tether assembly 65 from the flexible link 18 and is independent of the cylinder 76 activation. After work is completed on the flexible link 18, the clamshell can be deactivated and if desired the shims 128 removed to allow the transfer assembly 56 to extend to a greater length, such as back to the length A. The load can thereby can be transferred back to the flexible link 18 and if desired the tether assembly 65 can be removed from the floatation system 2.

The shims 128 can have a further use besides taking up slack in the mechanical interlock 58. In some instances, the load on the tether assembly 65 may need adjustment in smaller increments than is available through the interaction of the clamshell 118 in the receptacle 96 and grooves 127 in the transfer leg 98, and for other embodiments of the mechanical interlocks 58 described herein. The shims 128 can be used to adjust the load in smaller increments by varying the length of the transfer leg 98 engagement with the receptacle 96 in such smaller increments.

This ability to adjust in smaller increments can be useful, for example, when the full load of the flexible link 18 is not desired to be transferred to the one or more tether assemblies 65. For example, the floatation system 2 could have an increased need for additional load not initially designed for the existing flexible link 18, and the one or more tether assemblies 65 could supplement the load capacity of the flexible link. Also, the flexible link could have some deterioration, yet not enough to require a full replacement, and the one or more tether assemblies could supplement the load capacity of the flexible link. In these and other exemplary instances, a partial load could be transferred from the flexible link 18 to the one or more tether assemblies 65 in the manner described above without requiring all the load to be transferred, so that the flexible link and the tether assemblies together support the load. While the general movement between the transfer blocks using the mechanical interlocks 58 described herein could adjust for some of the load, the shims 128 could provide smaller increments for adjustments of such load.

Figure 10A:
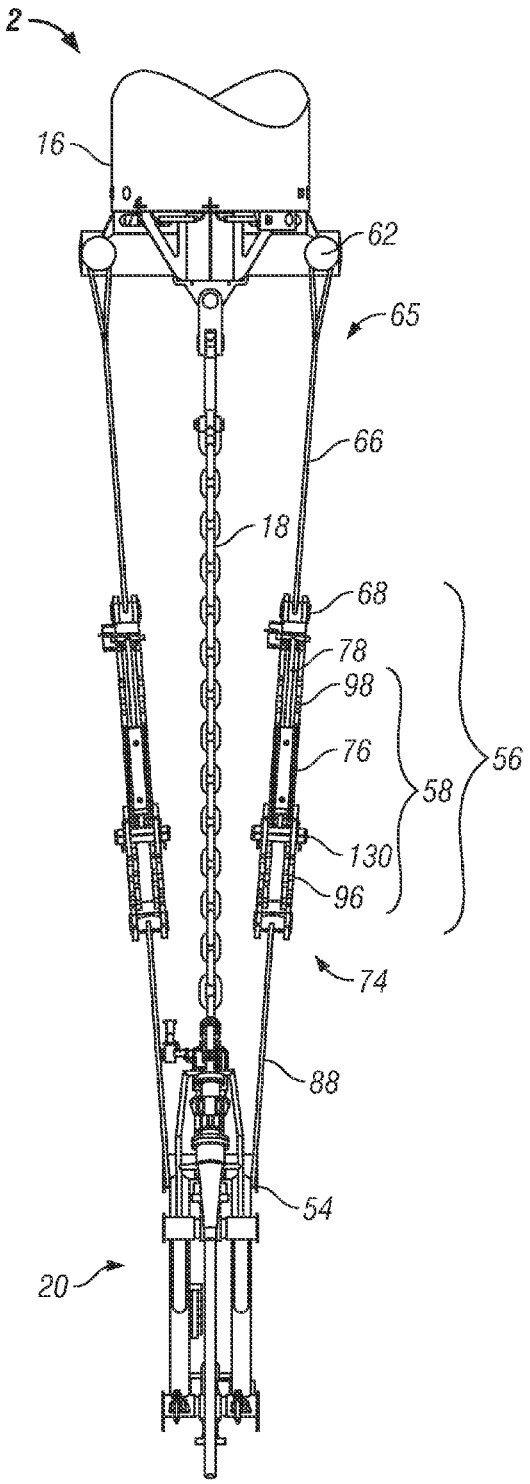
FIG. 10A is a schematic front view of an exemplary tether assembly with another transfer assembly.
Figure 10B:
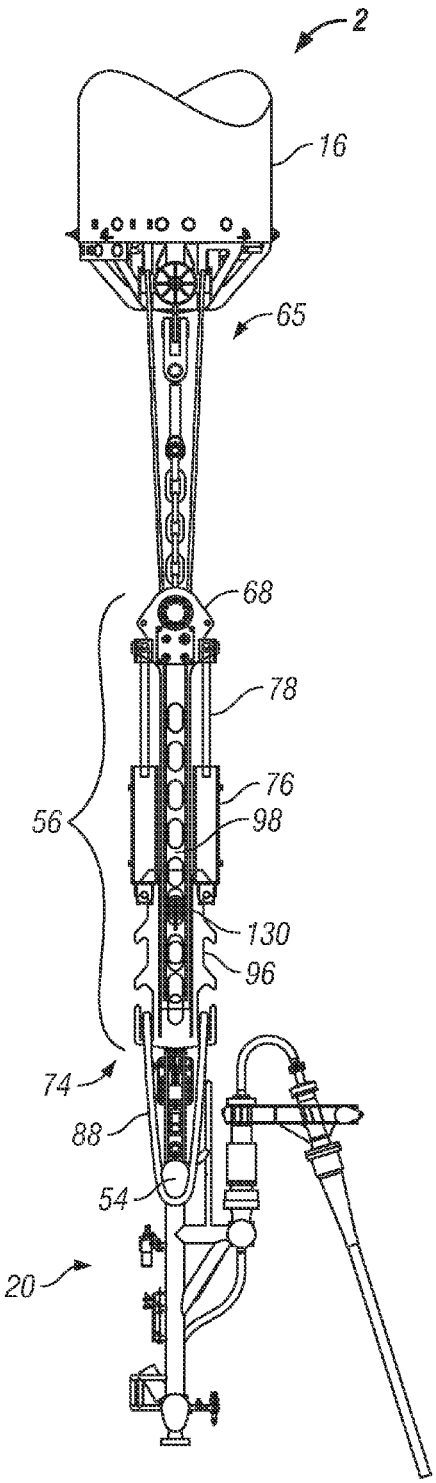
FIG. 10B is a schematic side view of the system in FIG. 10A with the tether assembly.
Figure 10E:
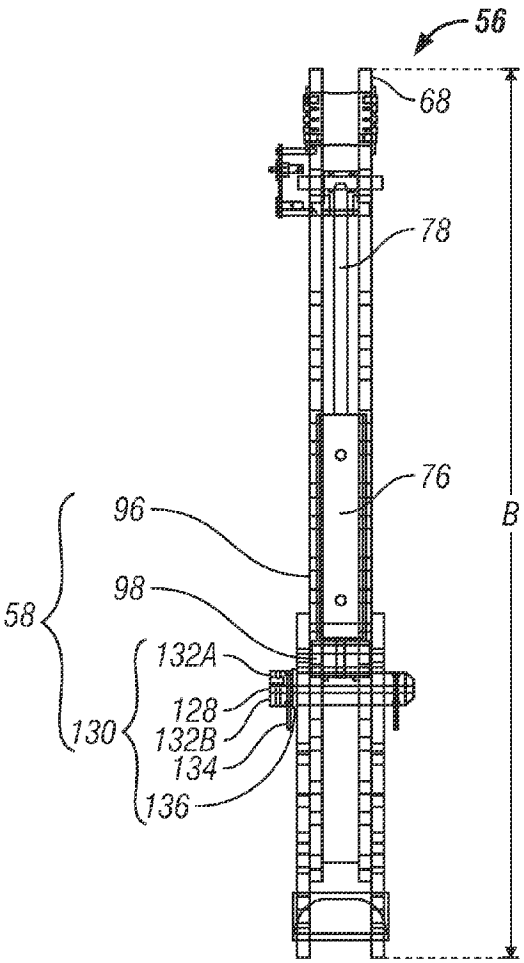
FIG. 10E is a schematic side view of the transfer assembly of FIG. 10C in a second position with a mechanical interlock for in-situ transfer for the load on the flexible link.
Figure 10D:
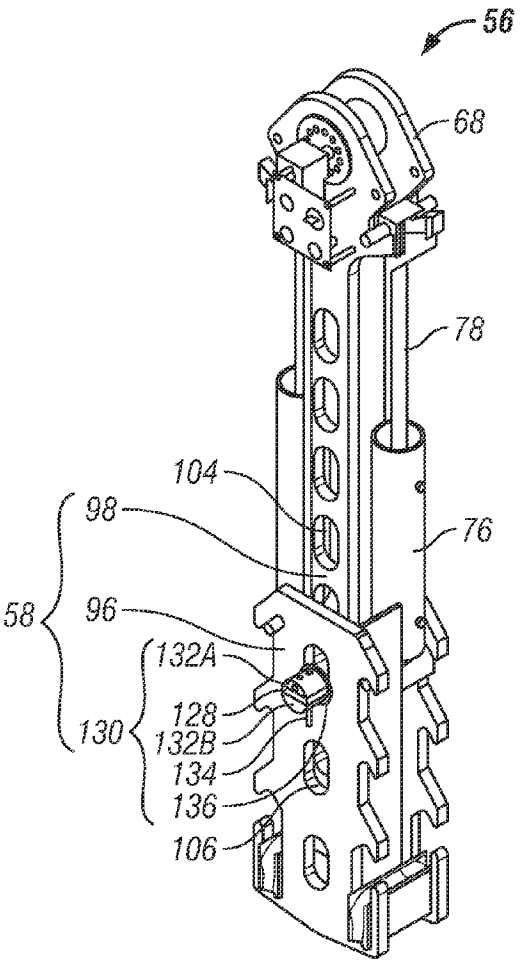
FIG. 10D is a schematic perspective view of the transfer assembly of FIG. 100 in the first position.
Figure 10C:
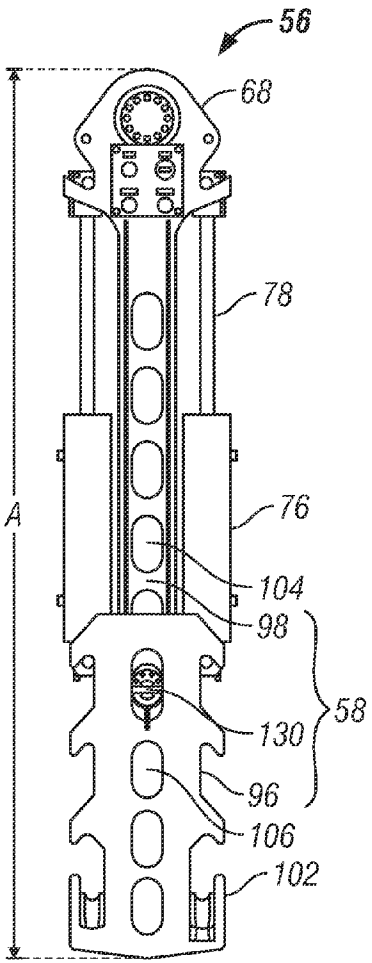
FIG. 10C is a schematic side detail view of a portion of the tether assembly of FIG. 10B, illustrating the transfer assembly in a first position with a mechanical interlock.
Figure 10F:
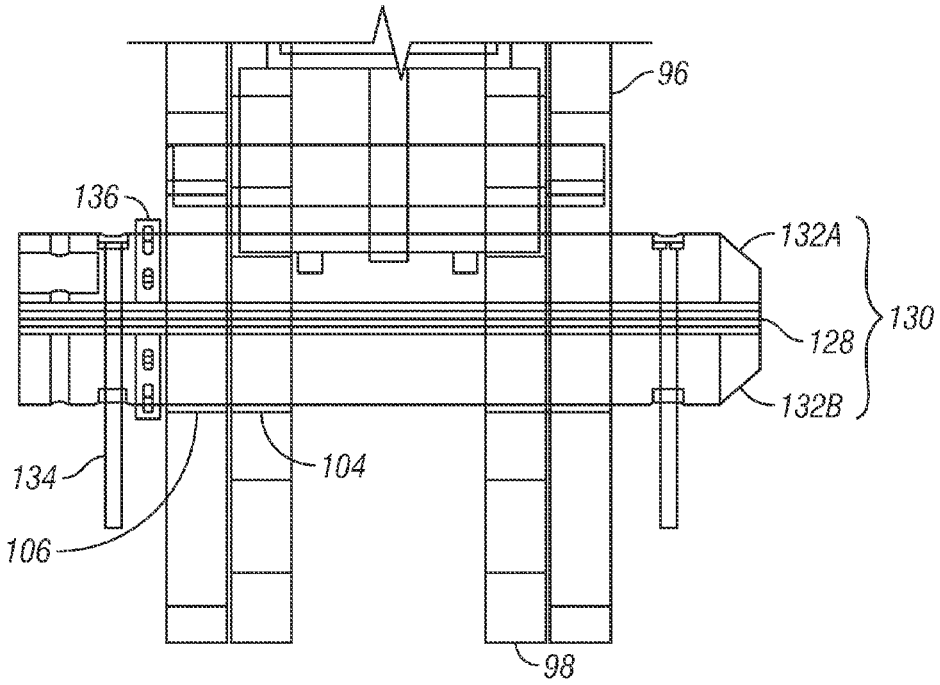
FIG. 10F is a schematic side detail view of the mechanical interlock of the transfer assembly of FIG. 10C.
Figure 10G:
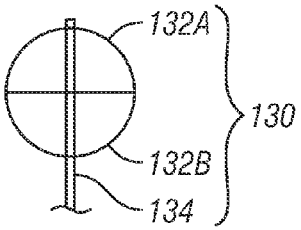
FIG. 10G is a schematic end view of the shimmed pin without shims.
Figure 10H:
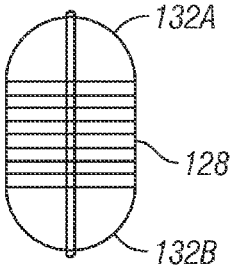
FIG. 10H is a schematic end view of the shimmed pin with a plurality of shims.
Figure 10I:
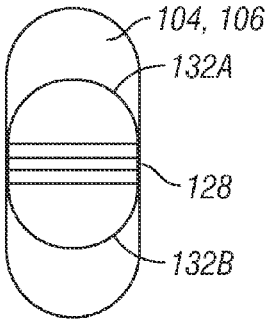
FIG. 10I is a schematic end view of the shimmed pin with an intermediate number of pins, the pin being inserting in an aligned set of receptacle and leg openings.

FIG. 10A is a schematic front view of an exemplary tether assembly with another transfer assembly. FIG. 10B is a schematic side view of the system in FIG. 10A with the tether assembly. FIG. 10C is a schematic side detail view of a portion of the tether assembly of FIG. 10B, illustrating the transfer assembly in a first position with a mechanical interlock. FIG. 10D is a schematic perspective view of the transfer assembly of FIG. 10C in the first position. FIG. 10F is a schematic side detail view of the mechanical interlock of the transfer assembly of FIG. 10C. FIG. 10E is a schematic side view of the transfer assembly of FIG. 10C in a second position with a mechanical interlock for in-situ transfer for the load on the flexible link. FIG. 10G is a schematic end view of the shimmed pin without shims. FIG. 10H is a schematic end view of the shimmed pin with a plurality of shims. FIG. 10I is a schematic end view of the shimmed pin with an intermediate number of pins, the pin being inserting in an aligned set of receptacle and leg openings. The figures will be described in conjunction with other.

This embodiment is a variation of the transfer assembly embodiment described in FIGS. 6A-6G using shims to incrementally adjust the interaction between the transfer leg 98 in the receptacle 96. As described above, when it is desired to transfer at least a portion of a tensile load from the flexible link 18, the tether assembly 65 can be installed between the buoyancy can 16 and the riser support connection 20 using, for example, lugs 62, 54, respectively. The transfer assembly 65 includes one or more slings 66, 88 coupled to a transfer assembly 56. The transfer assembly 56 can include a transfer block 68 on one end and a transfer block 74 on the other end. The transfer assembly 56 can further include a mechanical interlock 58 that is formed by a receptacle 96 that is slidably coupled with a transfer leg 98 therethrough. The receptacle 96 includes one or more receptacle openings 106, and the transfer leg 98 includes one or more leg openings 104. The transfer assembly 56 can have a first length A when the transfer assembly is in a first position. The transfer assembly 56 can have a second length B that is shorter than the length A when the cylinders 76 have been activated and have drawn in their respective rods 78 into the cylinders to shorten the length of the transfer assembly 56. A shim pin 130 can be inserted through an aligned pair of openings 104, 106 between the transfer leg 98 and the receptacle 96.

One or more of the openings can be eccentrically shaped to facilitate alignment, such as under adverse conditions. However, the eccentric shape can allow slack in the openings in the transfer leg 98 and the receptacle 96 that allows a float distance and variation on the length B. If desired, the shim pin 130 can be shimmed to better fit the aligned pair of openings between the transfer leg and the receptacle, and/or to adjust the load on the transfer assembly 56 and therefore the tether assembly 65.

In at least one embodiment, the shim pin 130 can include a first shim pin portion 132A removably coupled with a second shim pin portion 132B. The shim pin portions 132A, 132B can be separated, so that one or more shims 128 can be inserted therebetween to change its cross sectional dimension. If desired, the shim portions 132A, 132B can be coupled to each other by one or more fasteners 134. A stop collar 136 can be used on one or both ends of the shim pin 130 to restrict lateral movement of the shim pin in the openings 104, 106. When the shim pin 130 is inserted through the openings 104, 106, the mechanical interlock 58 system 58 is activated. Maintenance, replacement, repairs, total load transfer, partial load transfer, or other efforts can be made on the flexible link 18, when the transfer assembly 56 is mechanically interlocked at the length B. After the efforts are completed, the shim pin 130 can be removed, thereby deactivating the mechanical interlock 58 to allow the transfer assembly 56 to extend outward and transfer the load from the tether assembly 65 to the flexible link 18.

Figure 11A:
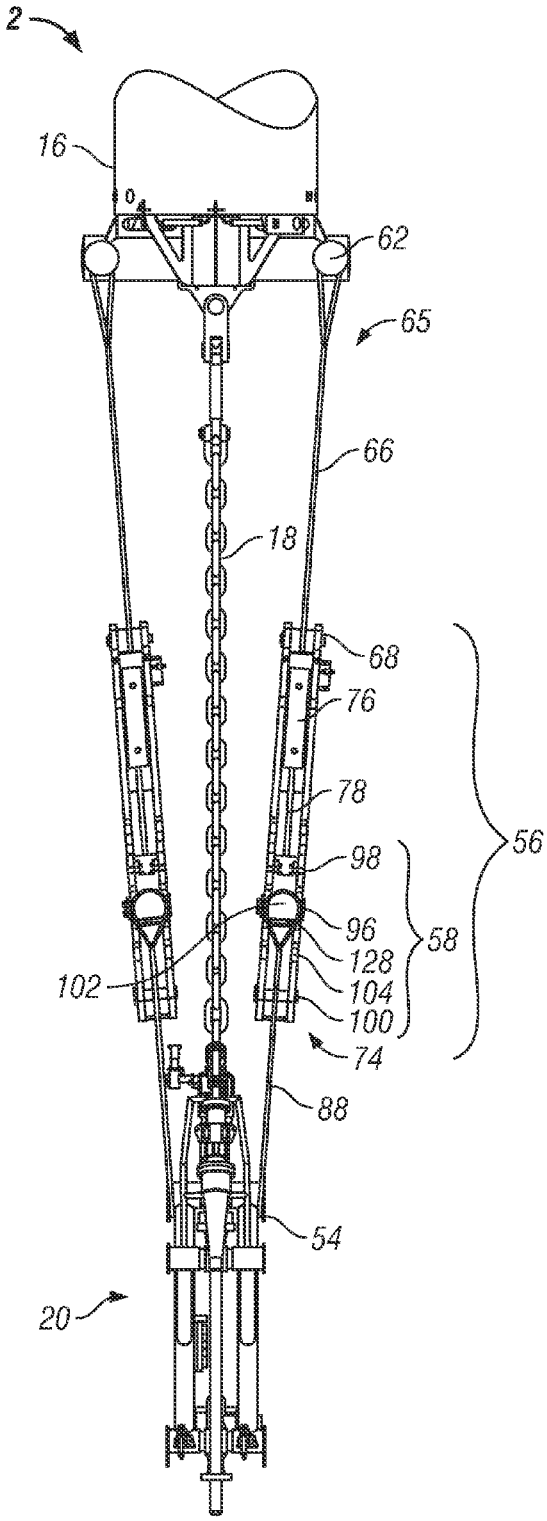
FIG. 11A is a schematic front view of an exemplary tether assembly with another transfer assembly.
Figure 11B:
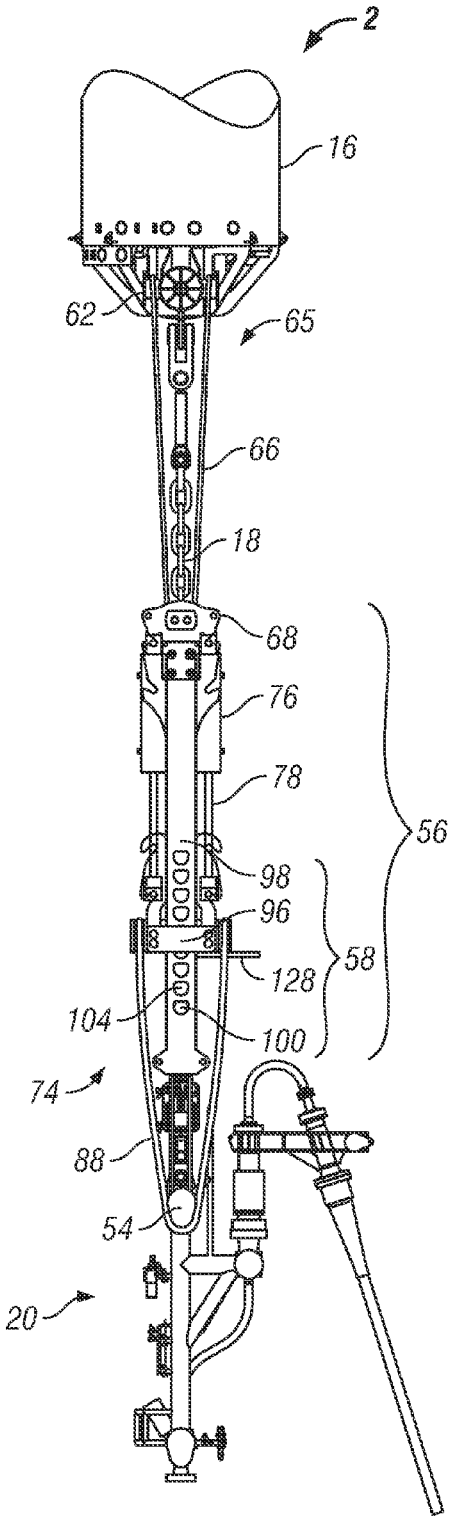
FIG. 11B is a schematic side view of the system in FIG. 11A with the tether assembly.
Figure 11E:
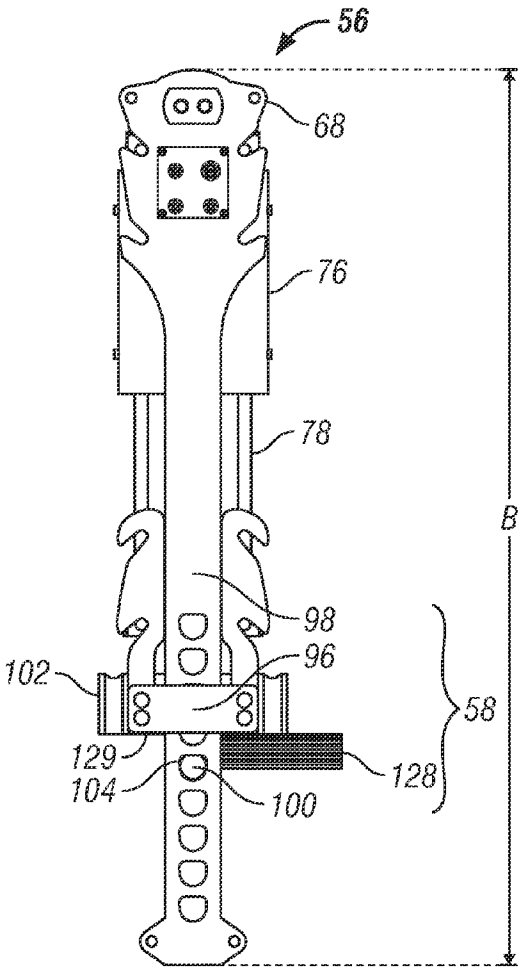
FIG. 11E is a schematic side view of the transfer assembly of FIG. 11C in a second position with a mechanical interlock for in-situ transfer for the load on the flexible link.
Figure 11D:
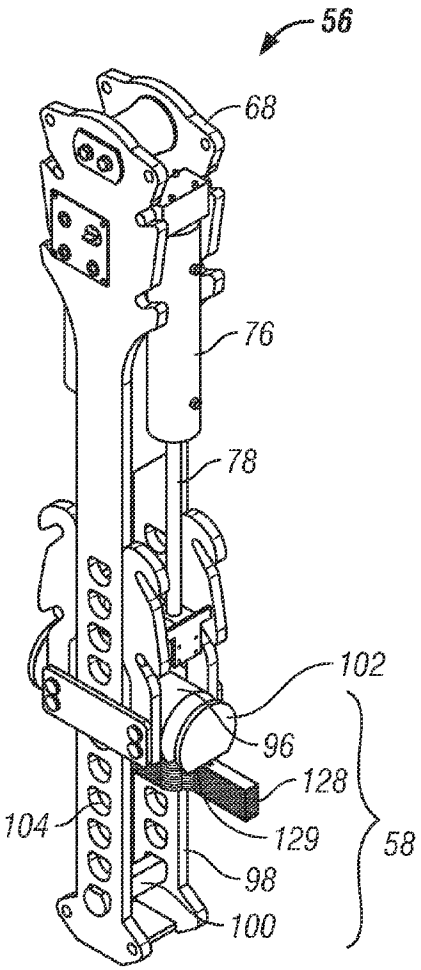
FIG. 11D is a schematic perspective view of the transfer assembly of FIG. 11C in the first position.
Figure 11C:
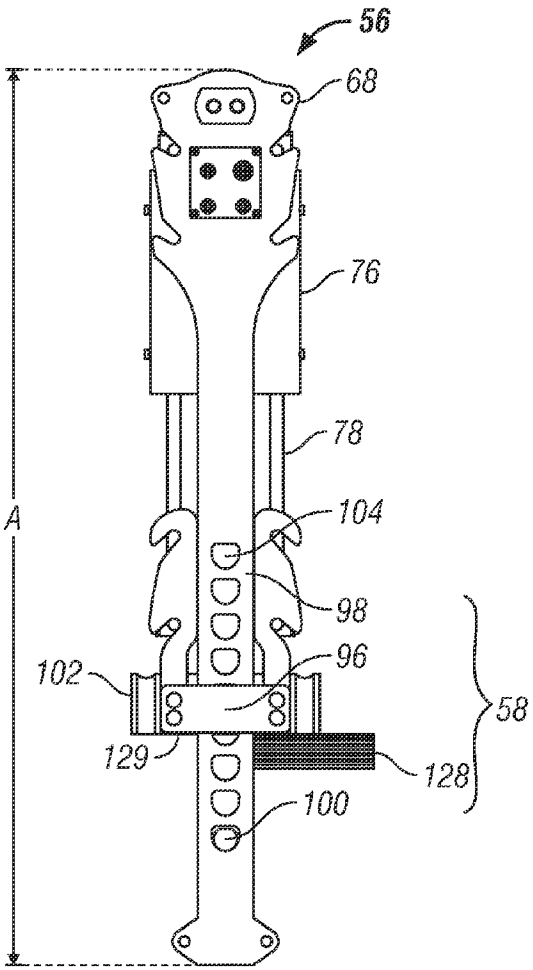
FIG. 11C is a schematic side detail view of a portion of the tether assembly of FIG. 11B, illustrating the transfer assembly in a first position with a mechanical interlock.

FIG. 11A is a schematic front view of an exemplary tether assembly with another transfer assembly. FIG. 11B is a schematic side view of the system in FIG. 11A with the tether assembly. FIG. 11C is a schematic side detail view of a portion of the tether assembly of FIG. 11B, illustrating the transfer assembly in a first position with a mechanical interlock. FIG. 11D is a schematic perspective view of the transfer assembly of FIG. 11C in the first position. FIG. 11E is a schematic side view of the transfer assembly of FIG. 11C in a second position with a mechanical interlock for in-situ transfer for the load on the flexible link. The figures will be described in conjunction with other.

The floatation suspension 2 includes a buoyancy can 16 coupled through a flexible link 18 to a riser support connection 20. A tether assembly 65 can be coupled between the buoyancy can 16 and the riser support connection 20 when efforts are made to the flexible link 18 and the tensile load at least partially transferred therefrom. The tether assembly 65 can include a sling 66 coupled between the buoyancy can 16 at the lug 62 on one end and coupled to a transfer block 68 on a tether assembly 56 at the other end. Similarly, a sling 88 can be coupled to a lug 54 on the riser support connection 20 on one end and coupled to a lug 102 on a second transfer block 74 at the other end of the transfer assembly 56. The transfer assembly 56 can include one or more hydraulic cylinders 76 and their associated rods 78 that are coupled between the transfer blocks 68, 74. A transfer leg 98 is coupled to the transfer block 68. A receptacle 96 is coupled to the transfer block 74. The transfer leg 98 is slidably engaged with the receptacle 96. The transfer leg 98 has one of more openings 104 formed therethrough. A pin 100 can be removably inserted in one of more of the leg openings 104. The bottom of the receptacle 96, as shown in the orientation of the figures, forms a supporting surface 129 for the pin 100 and/or one or more shims 128. The transfer assembly 56 has a first length A after installation to the floatation system 2 and before activation of the hydraulic cylinder 76. After activation of the hydraulic cylinder 76, the length of the transfer assembly 56 can be reduced to a length B. As the length is reduced, the transfer leg 98 slidably moves relative to the receptacle 96. The pin 100 can be inserted into an appropriate leg opening 104 that is in close proximity to the receptacle 96 and the supporting surface 129. For any slack that may remain or for any tensile load that may need incremental adjustment, one or more shims 128 can removably inserted between the pin 100 and supporting surface 129 of the receptacle 96.

It is understood that the arrangement of the pin, transfer leg, and receptacle could be altered, so that pin could be inserted in one or more openings of a plurality of openings in the receptacle to vary the length of engagement with the transfer leg and shims could be removably inserted between the pin and a supporting surface of the transfer leg.

If repairs or replacement of the flexible link are intended, the efforts can be made on the flexible link 18 when the mechanical interlock 58 is activated. After efforts are completed, the mechanical interlock 58 can be released and deactivated, so that the transfer assembly 56 can extend to a length greater than the reduced length B and release the load from the tether assembly 65 to the flexible link 18. The tether assembly 65 can be optionally removed thereafter.

Figure 12A:
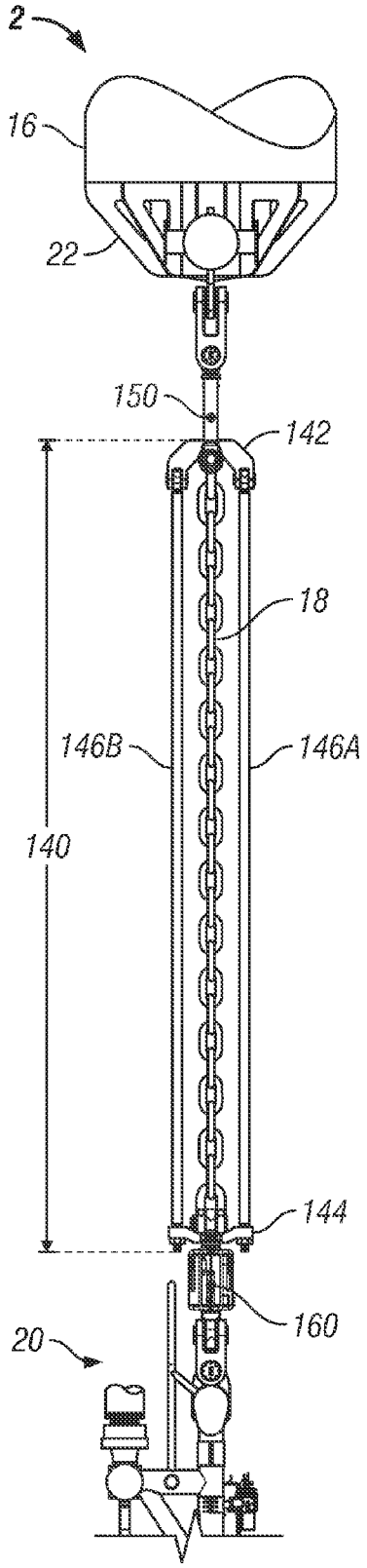
FIG. 12A is a schematic side view of a support assembly of the present invention.
Figure 12B:
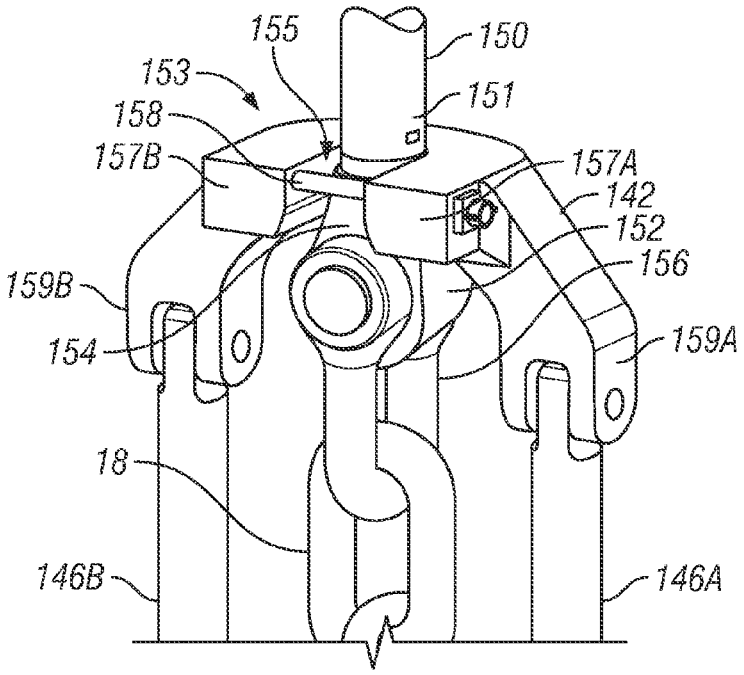
FIG. 12B is a detailed perspective view of an upper load collar of the embodiment of FIG. 12A.
Figure 12C:
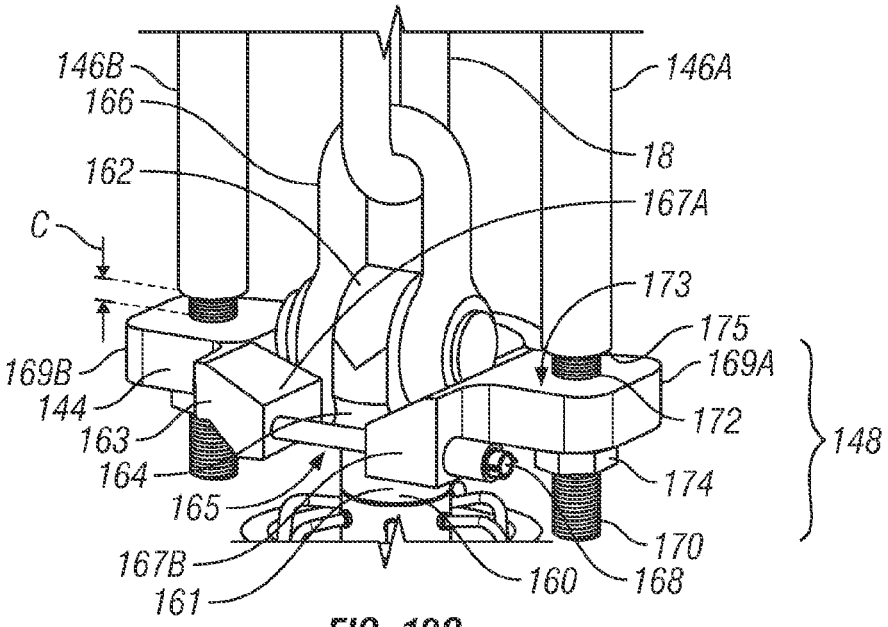
FIG. 12C is a detailed perspective view of a lower load collar of the embodiment of FIG. 12A.

FIG. 12A is a schematic side view of another exemplary system of the present invention. FIG. 12B is a detailed perspective view of an upper load collar of the embodiment of FIG. 12A. FIG. 12C is a detailed perspective view of a lower load collar of the embodiment of FIG. 12A. The figures will be described in conjunction with each other. The floatation suspension system 2 can include the buoyancy can 16 coupled to an upper portion 138 of a flexible link 18 and a riser support connection 20 coupled to a lower portion 139 of the flexible link distal from the upper portion. More specifically, the buoyancy can 16 can be coupled with an upper connector 22 that can be coupled with an upper load support 150 that can be coupled with a clevis 156 on an upper portion of the flexible link 18. Similarly, the riser support connection 20 can be coupled with a lower load support 160 that can be coupled with a clevis 166 on a lower end of the flexible link 18. The upper load support 150 can include a rod 151 that transitions into a larger cross-section, load support coupler 152 with which the clevis 156 can be coupled. A shoulder 154 is formed between the transition of the rod 151 and the support coupler 152. Similarly, the lower load support 160 includes a rod 161 that transitions into a larger cross-section, load support coupler 162 with which the clevis 166 can be coupled. A shoulder 164 is formed between the transition of the rod 161 and the support coupler 162.

A support assembly 140 can provide an additional measure of safety for coupling of the floatation suspension system 2 between the buoyancy can 16 and the riser support connection 20 with the flexible link 18. If the flexible link 18 becomes damaged and compromised in effectiveness, the support assembly 140 can provide continued coupling for the floatation suspension system 2 while repairs or replacements occur, such as with use of the prior described embodiments of the transfer assembly 56 shown in FIGS. 5A-11E. The support assembly 140 can be coupled after the flexible link 18 is determined to need repair or replacement, or can be coupled prior to such event as a precaution to such event.

Further, in some instances with appropriate orientation of the support blocks 142, 144, the flexible link 18 can be removed and repaired or replaced, while the support assembly 140 maintains the coupling between the buoyancy can 16 and the riser support connection 20.

The support assembly 140 can be coupled between the upper load support 150 and the lower load support 160. The support assembly 140 can include an upper support block 142 in the general shape of a "U" and a lower support block 144 in the general shape of a "U," with other shapes being permissible, and at least one support link 146, such as the illustrated pair of links 146A, 146B, coupled therebetween. In at least one advantageous embodiment, the support link 146 can be a rigid tie rod, although other coupling elements can be used that are rigid or flexible.

The upper support block 142 can include a collar 153 formed from a pair of flanges 157A, 157B that protrude laterally to a longitudinal axis of the rod 151. An opening 155 is formed between the flanges. The opening 155 has a dimension greater than a cross section of the rod 151, but smaller than a cross section of the load support coupler 152. The collar 153 can be placed around the rod 151 with the rod disposed in the opening 155 and supported by the shoulder 154 to restrict movement of the collar (and hence the upper support block 142) toward the lower support block 144. A pin 158 can be inserted into openings between the flanges 157 after the collar 153 is disposed around the rod 151 to restrict lateral movement of the collar by closing the opening 155 to avoid disengagement with the load support 150.

The support block 144 can include a collar 163 formed from a pair of flanges 167A, 167B that protrude laterally to a longitudinal axis of the rod 161. An opening 165 is formed between the flanges. The opening 165 has a dimension greater than a cross section of the rod 161, but smaller than a cross section of the load support coupler 162. The collar 163 can be placed around the rod 161 with the rod disposed in the opening 165 and supported by the shoulder 164 to restrict movement of the collar (and hence the lower support block 144) toward the upper support block 142. A pin 168 can be inserted into openings between the flanges 167 after the collar 163 is disposed around the rod 161 to restrict lateral movement of the collar by closing the opening 165 to avoid disengagement with the load support 160.

The upper and lower support blocks can be coupled together by the support links 146A, 146B. In at least one embodiment, the upper support block 142 includes one or more arms 159A, 159B and the lower support block 144 includes one or more arms 169A, 169B that can be used to support the support links 146A, 146B on each respective support block. Without limitation, the support links 146 can be hingeably coupled to the arms 159 of the support block 142 and adjustably coupled to the arms 169 of the support block 144.

The effective length of the support link 146 between the support blocks 142, 144 can be adjustable by adjusting a location of a fastener 174 (such as a nut) on a fastening portion 170 of the support links 146 (such as on threads on a rod). The fastening portion 170 can be coupled through an opening 172 of the arm 169, with a limit stop 175 of the fastening portion having a clearance C from an arm surface 173 with the fastener 174 located on an opposite face of the arm. As the clearance C changes to a smaller dimension such as from tightening the fastener 174, the support blocks 142, 144 are moved into closer proximity to each other. In some embodiments with sufficient adjustment amount, the tensile load between the buoyancy can 16 and the riser support connection 20 on the flexible link 18 can at least partially transferred to the support assembly 140. When enough movement of the support blocks 142, 1444 toward each other causes sufficient slack in the flexible link 18, the flexible link 18 can be removed and repaired or replaced, while the support links 146 support the transferred load and maintain the distance between the support blocks. The combination of the fastening portion 170, the fastener 174, and the arm 169 forms a tension assembly 148 that can support the load along the length of the support link 146. In at least one embodiment, the fastener 174 includes a nut that can be rotated with a wrench from an ROV around a threaded fastening portion 170 to increase or decrease the clearance C.

After the flexible link is repaired or replaced, and is reinstalled or otherwise secured between the load support couplers 152, 162, the fastener 174 can be moved along the length of the fastening portion 170 of the support link 146 to increase the clearance C and cause the load between the buoyancy can 16 and the riser support connection 20 on the support assembly 140 to be transferred back to the flexible link 18. After transferring the load to the flexible link 18, the pins 158, 168 can be removed and the support blocks 142, 144 with the support links 146 can be removed from the load supports 150, 160, respectively.

Figure 12D:
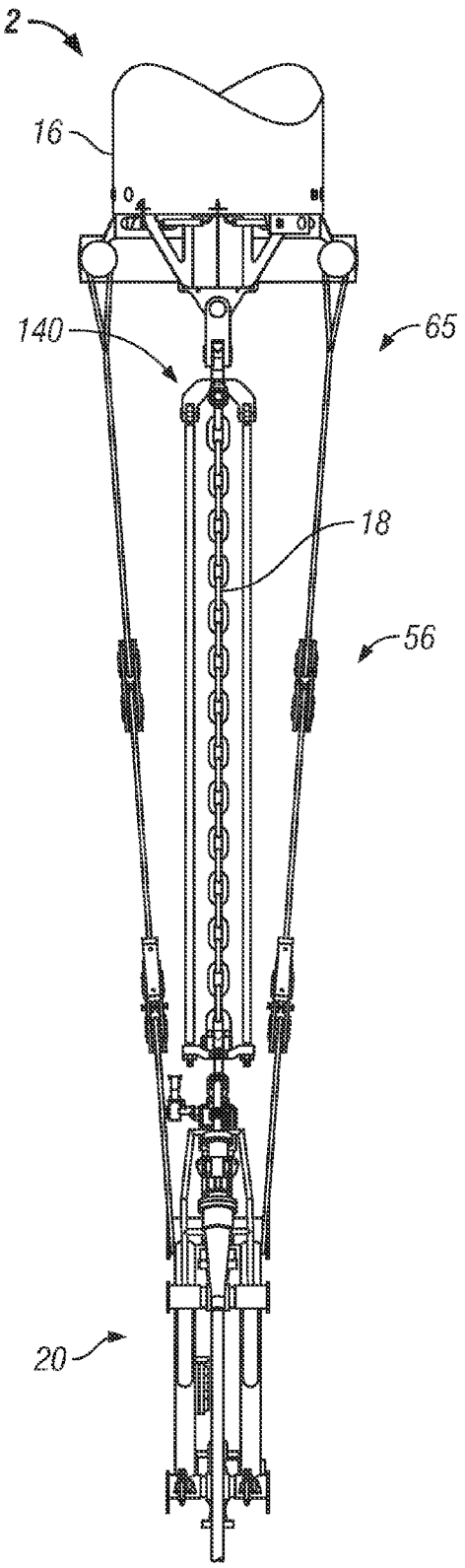
FIG. 12D is a schematic perspective view of an exemplary system of the floatation system coupled with an exemplary tether assembly system in combination with an exemplary support assembly.

FIG. 12D is a schematic perspective view of an exemplary system of the floatation system coupled with an exemplary tether assembly system in combination with an exemplary support assembly. In at least one embodiment, the support assembly 140 can be coupled at or prior to use of the tether assembly 65 with the transfer assembly 56. The support assembly 140 can provide additional assurance of the coupling between the buoyancy can 16 and the riser support connection 20 while the flexible link 18 is repaired or replaced using the tether assembly 65 with the transfer assembly 56 as described herein.

Figure 13B:
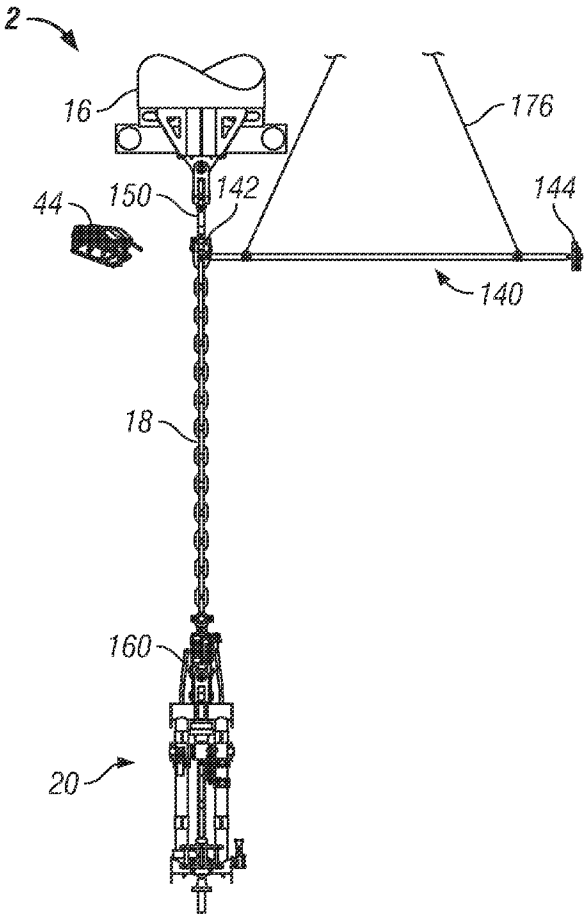
FIG. 13B is a schematic view of a floatation suspension system of FIG. 13A with the support assembly partially coupled.
Figure 13A:
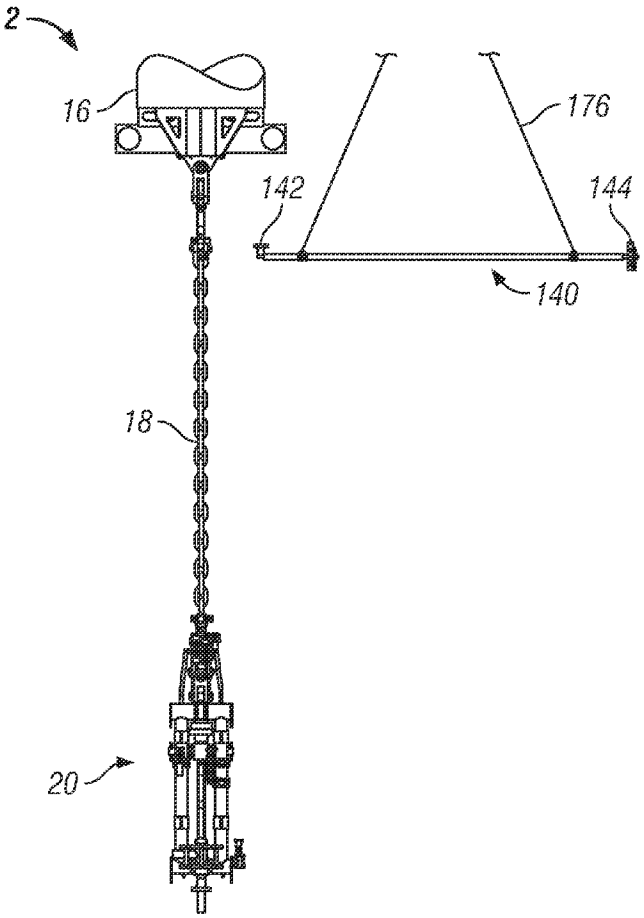
FIG. 13A is a schematic view of a floatation suspension system with a support assembly.
Figure 13D:
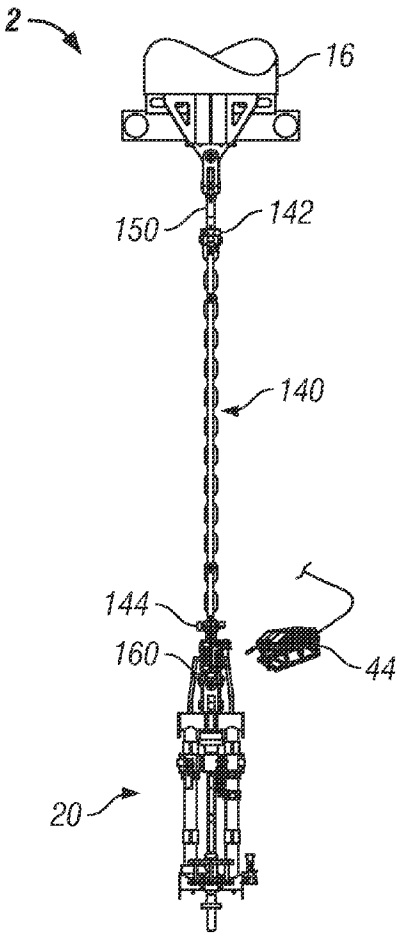
FIG. 13D is a schematic view of a floatation suspension system of FIG. 13A with the support assembly fully coupled.
Figure 13C:
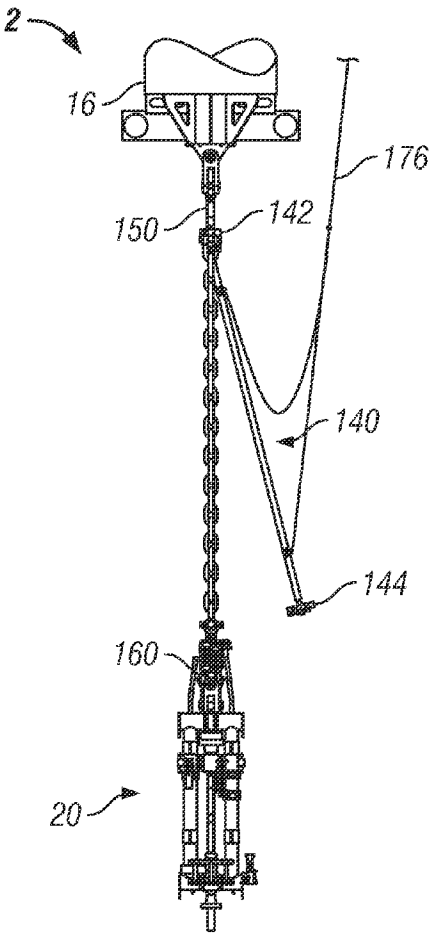
FIG. 13C is a schematic view of a floatation suspension system of FIG. 13A with the support assembly partially coupled and pivoted about the partially coupled portion.

FIG. 13A is a schematic view of a floatation suspension system with a transfer assembly. FIG. 13B is a schematic view of a floatation suspension system of FIG. 13A with the transfer assembly partially coupled. FIG. 13C is a schematic view of a floatation suspension system of FIG. 13A with the transfer assembly partially coupled and pivoted about the partially coupled portion. FIG. 13D is a schematic view of a floatation suspension system of FIG. 13A with the transfer assembly fully coupled. The figures will be described in conjunction with each other and describe a possible but non-limiting sequence for use of the transfer assembly described in reference to FIGS. 12A-12C.

The floatation suspension system 2 can include the buoyancy can 16 coupled with a flexible link 18 to a riser support connection 20. A tensile load is created between the buoyancy can 16 and the riser support connection 20 that is supported through the flexible link 18. A vessel (not shown) can lower a sling 176 that supports the transfer assembly 56 in proximity to the flexible link 18. An ROV 44 can couple one of the transfer blocks, such as the upper transfer block 68, with one of the load supports, such as the upper load support 150. The remainder of the transfer assembly 56 can be lowered in a pivoting fashion about the transfer block that has been coupled so that the other transfer block, such as the lower transfer block 74, can be in proximity to the other load support, such as the lower load support 160. The ROV 44 can couple the other transfer block to the other load support, so that both transfer blocks 68, 74 are coupled to both load supports 150, 160. It is noted that the load supports 150, 160 are exemplary and without limitation as points of coupling for the transfer assembly 56, because other members coupled to the buoyancy can 16 and other members coupled to the riser support connection 20 can be used to allow the load on the flexible link 18 to be at least partially transferred to the transfer assembly 56.

Figure 14:
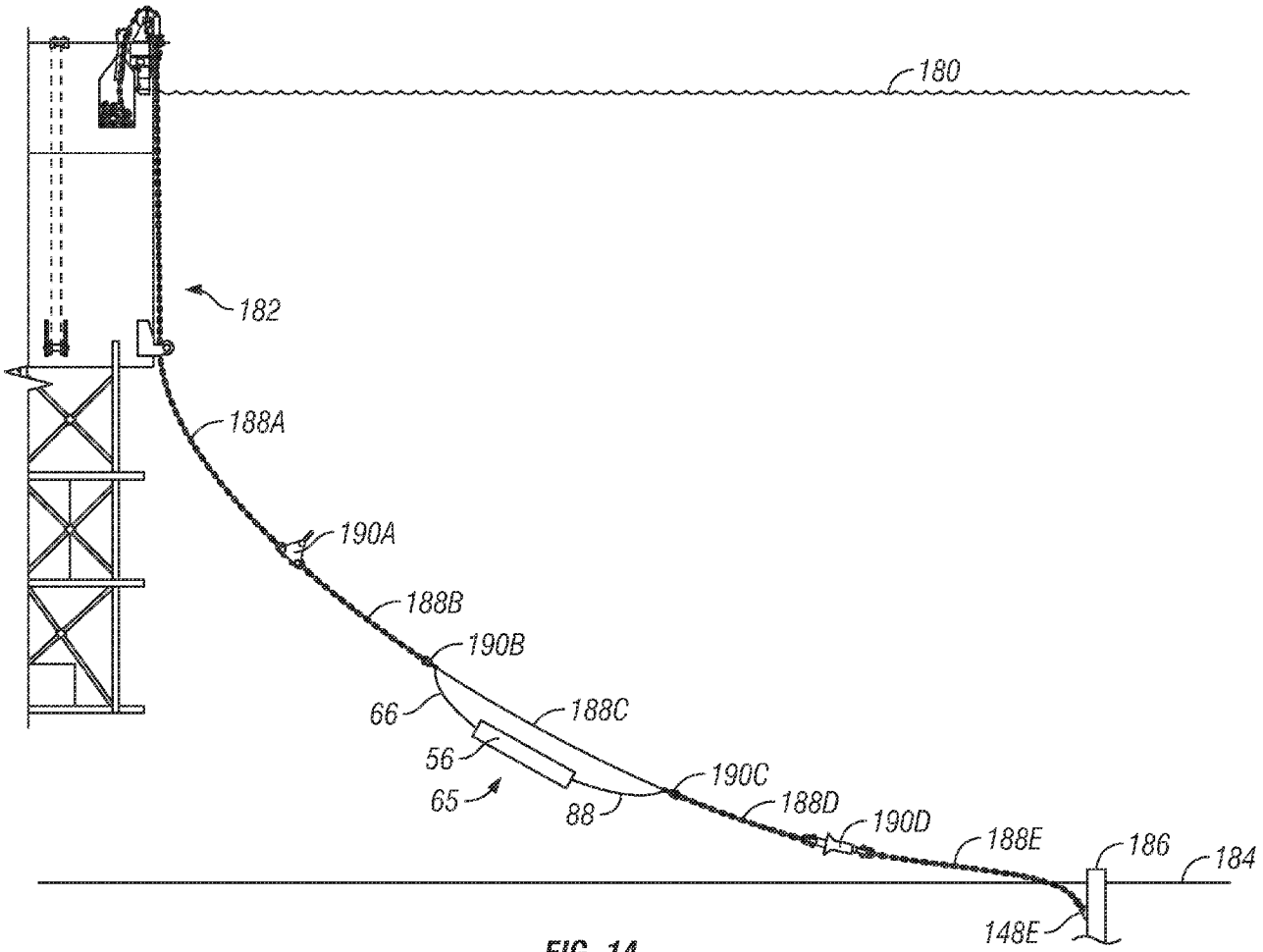
FIG. 14 is a schematic elevation view of another embodiment of the system with the tether assembly described herein that can be inserted between two bodies with a flexible link therebetween having with a tensile load.

FIG. 14 is a schematic elevation view of another embodiment of the system with the tether assembly described herein that can be inserted between two bodies with a flexible link therebetween having with a tensile load. The above discussions have used a floatation system as an exemplary application of the present invention. However, the invention can be used in other applications. One such other nonlimiting application is a mooring line system between an offshore platform and a pile installed into a seabed. The principles and embodiments described herein can be applied to these and other tensile loaded systems.

An offshore platform 182 is illustrated as a spar, with the understanding that any offshore platform that is moored with mooring lines could be illustrated. The offshore platform 182 is designed to operate at a nominal water level 180. Generally, each mooring line 188, as an example of a "flexible link" described above, is coupled to a pile 186 that is driven into the seabed 184 as an anchoring element. The mooring line is under a tensile load between the offshore platform and the pile. The mooring line 188 can have a significant length of several kilometers (miles) and is generally assembled in one or more portions, such as portions 188A, 188B, 188C, 188D, 188E. One or more couplers, such as couplers 190A, 190B, 190C, 190D, 190E, can be used to couple the portions together. The couplers can be shackles, master links, triplates, hooks, padeyes, quick release assemblies, subsea mooring connectors, and other couplers known to those in the art.

The mooring line, a portion of the mooring line, or a coupler can become damaged or otherwise need replacing or repair. The present invention provides a method of replacing or repairing such elements, while substantially maintaining the tensile load between the two bodies, such as the offshore platform and the pile. Further, the present invention provides a method of transferring at least a portion of the tensile load from such elements as described above, for example, to provide additional support to the mooring line or portion. For example, if a mooring line portion 188C needs at least a partial transfer of the tensile load therefrom, a tether assembly 65 can be coupled at some appropriate position, such as using couplers 190B and 190C with slings 66, 88. A transfer assembly 56 of the tether assembly 65 can be activated to reduce the length of the transfer assembly 56 and be mechanically interlocked, as described above in the exemplary embodiments. As a result, the length of the tether assembly 65 is also reduced and at least a portion of the tensile load is transferred from the mooring line portion 188C to the tether assembly 65. If replacement or repair efforts are intended, after the efforts are completed, the mechanical interlock on the transfer assembly 56 can be deactivated, the transfer assembly can be lengthened, and the load transferred back to the mooring line portion 188C and from the tether assembly 65 if desired.

Other and further embodiments utilizing one or more aspects of the inventions described above can be devised without departing from the spirit of Applicant's invention. For example, the tether assembly can be used in initial installations of tensile loads on flexible links, before loads are transferred to the flexible links. The various couplers (such as pins and clamshells) and their respectively couplings between the transfer leg and receptacle can be altered from the arrangement above so that the coupler is stationary to the transfer leg and couples to the receptacle at a variety of positions. Further, a plurality of flexible links can be used in one or more embodiments. Further, the various methods and embodiments of the tether assemblies and transfer assemblies can be included in combination with each other to produce variations of the disclosed methods and embodiments.

Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, the Applicant intends to protect fully all such modifications and improvements that come within the scope or range of equivalent of the following claims.

What is claimed is:

1. A system for in-situ transfer of at least a portion of a tensile load from a flexible link coupled between at least two bodies, comprising:

a first tether assembly coupled between the two bodies and comprising at least one hydraulic cylinder with a cylinder rod slidably disposed therein and at least one transfer assembly, the hydraulic cylinder being configured upon actuation to decrease a distance between the two bodies and thereby transfer at least a portion of the tensile load from the flexible link to the tether assembly; and the transfer assembly comprising:

a first transfer block;

a second transfer block;

the hydraulic cylinder coupled to the transfer blocks; and a mechanical interlock configured upon mechanical actuation to maintain the decreased distance between the two bodies with at least a portion of the tensile load transferred to the tether assembly independently of the hydraulic cylinder.

2. The system of claim 1, wherein the mechanical interlock comprises a first eccentric pulley rotatably coupled to one of the transfer blocks, the first eccentric pulley configured to allow a first distance between the two bodies in a first rotational position and a second distance between the two bodies that is shorter than the first distance in a second rotational position.

3. The system of claim 2, further comprising a second pulley rotatably coupled to another of the transfer blocks different from the transfer block with the first eccentric pulley and a transfer sling coupled between the first eccentric pulley and the second pulley.

4. The system of claim 1, wherein the mechanical interlock comprises:

a transfer leg coupled to one of the transfer blocks;

a receptacle coupled to another of the transfer blocks; and a coupler coupled with the transfer leg, the receptacle, or both and configured to allow the transfer leg to be coupled to the receptacle at one or more positions to establish one or more lengths of the transfer assembly.

5. The system of claim 1, wherein the mechanical interlock comprises:

a transfer leg coupled to one of the transfer blocks;

a receptacle coupled to another of the transfer blocks; and a pin coupled with the transfer leg, the receptacle, or both and configured to allow the transfer leg to be coupled to the receptacle at one or more positions to establish one or more lengths of the transfer assembly.

6. The system of claim 1, wherein the mechanical interlock comprises:

a transfer leg coupled to one of the transfer blocks;

a receptacle coupled to another of the transfer blocks; and a clamshell coupled with the transfer leg, the receptacle, or both and configured to allow the transfer leg to be coupled to the receptacle at one or more positions to establish one or more lengths of the transfer assembly.

7. The system of claim 1, wherein the mechanical interlock comprises:

a transfer leg coupled to one of the transfer blocks;

a receptacle coupled to another of the transfer blocks; and a shim pin coupled with the transfer leg, the receptacle, or both and configured to allow the transfer leg to be coupled to the receptacle at one or more positions to establish one or more lengths of the transfer assembly, the pin having a first shim pin portion and a second shim pin portion with one or more shims inserted between the shim pin portions.

8. The system of claim 1, wherein the mechanical interlock comprises:

a transfer leg coupled to one of the transfer blocks;

a receptacle coupled to another of the transfer blocks;

a clamshell coupled with the transfer leg, the receptacle, or both and configured to allow the transfer leg to be coupled to the receptacle at one or more positions to establish one or more lengths of the transfer assembly; and one or more shims coupled between the clamshell and the receptacle.

9. The system of claim 1, wherein the mechanical interlock comprises:

a transfer leg coupled to one of the transfer blocks;

a receptacle coupled to another of the transfer blocks;

a pin coupled with the transfer leg, the receptacle, or both and configured to allow the transfer leg to be coupled to the receptacle at one or more positions to establish one or more lengths of the transfer assembly; and one or more shims coupled between the pin and the receptacle.

10. The system of claim 1, further comprising a support assembly coupled between the two bodies in addition to the flexible link.

11. The system of claim 10, wherein the support assembly comprises:

an upper support block coupled to an upper portion of the flexible link;

a lower support block coupled to a lower portion of the flexible link distal from the upper load support; and at least one support link coupled between the upper support block and lower support block.

12. The system of claim 1, wherein the two bodies comprise a buoyancy can and a riser support connection.

13. The system of claim 1, wherein the two bodies comprise an offshore platform and a pile.

14. A method of in-situ transferring at least a portion of a tensile load from a flexible link coupled between two bodies, comprising:

coupling at least one tether assembly between the two bodies with a first distance established between the two bodies, the tether assembly having a transfer assembly with at least two transfer blocks and a hydraulic cylinder with an associated cylinder rod coupled to the transfer blocks;

activating the hydraulic cylinder to move the two bodies closer from the first distance to a second distance that is less than the first distance; and mechanically interlocking by mechanically actuating the transfer assembly at the second distance independent of tension applied by the hydraulic cylinder to the transfer assembly.

15. The method of claim 14, further comprising:

releasing the mechanical interlock on the transfer assembly; and allowing the two bodies to separate to a distance greater than the second distance.

16. The method of claim 14, further comprising:

transferring the tensile load from the flexible link to the at least one tether assembly; and at least temporarily removing the flexible link from between the two bodies.

17. The method of claim 14, further comprising:

transferring less than the tensile load from the flexible link to the at least one tether assembly; and at least temporarily supporting the tensile load with the flexible link and the at least one tether assembly.

18. The method of claim 14, wherein the transfer assembly comprises at least one eccentric pulley rotatably coupled to at least one of the transfer blocks and coupled to a transfer sling disposed between the transfer blocks, and wherein mechanically interlocking the transfer assembly at the second distance comprises rotating the eccentric pulley from a first rotational position to a second rotational position.

19. The method of claim 14, wherein the transfer assembly comprises a transfer leg coupled to one of the transfer blocks and a receptacle coupled to another of the transfer blocks, and wherein mechanically interlocking the transfer assembly at the second distance comprises coupling a coupler to the transfer leg, the receptacle, or both at one or more positions to establish one or more lengths of the transfer assembly.

20. The method of claim 14, wherein the transfer assembly comprises a transfer leg coupled to one of the transfer blocks and a receptacle coupled to another of the transfer blocks, and wherein mechanically interlocking the transfer assembly at the second distance comprises coupling a pin to the transfer leg, the receptacle, or both at one or more positions to establish one or more lengths of the transfer assembly.

21. The method of claim 14, wherein the transfer assembly comprises a transfer leg coupled to one of the transfer blocks and a receptacle coupled to another of the transfer blocks, and wherein mechanically interlocking the transfer assembly at the second distance comprises coupling a clamshell to the transfer leg, the receptacle, or both at one or more positions to establish one or more lengths of the transfer assembly.

22. The method of claim 14, wherein the transfer assembly comprises a transfer leg coupled to one of the transfer blocks and a receptacle coupled to another of the transfer blocks, and wherein mechanically interlocking the transfer assembly at the second distance comprises:

coupling a shim pin to the transfer leg, the receptacle, or both at one or more positions to establish one or more lengths of the transfer assembly, and inserting one or more shims into the shim pin to change its cross-sectional dimension.

23. The method of claim 14, wherein the transfer assembly comprises a transfer leg coupled to one of the transfer blocks and a receptacle coupled to another of the transfer blocks, and wherein mechanically interlocking the transfer assembly at the second distance comprises:

coupling a clamshell to the transfer leg, the receptacle, or both at one or more positions to establish one or more lengths of the transfer assembly; and inserting one or more shims between the clamshell and the receptacle.

24. The method of claim 14, wherein the transfer assembly comprises a transfer leg coupled to one of the transfer blocks and a receptacle coupled to another of the transfer blocks, and wherein mechanically interlocking the transfer assembly at the second distance comprises:

coupling a pin to the transfer leg, the receptacle, or both at one or more positions to establish one or more lengths of the transfer assembly, and inserting one or more shims between the pin and the receptacle.

25. The method of claim 14, further comprising supporting the flexible link coupled between the two bodies by coupling a support assembly between an upper portion of the flexible link and a lower portion of the flexible link.

26. A system for in-situ support of at least two bodies having a flexible link coupled between the bodies with the flexible link having a tensile load, comprising:

a support assembly coupled between the two bodies in addition to the flexible link, comprising:

an upper support block coupled to an upper portion of the flexible link;

a lower support block coupled to a lower portion of the flexible link distal from the upper portion of the flexible link;

each of the support blocks having at least two arms that extend laterally to the flexible link;

at least two support links coupled between the two arms on the support blocks with at least one support link at least partially having a rigid rod with a fastening portion and configured to cause a distance between the upper support block and the lower support block to be adjusted;

wherein each of the support blocks comprise at least two flanges that extend laterally to the flexible link and at least partially surround the flexible link, load supports coupled to the flexible link, or a combination thereof.

27. The system of claim 26, further comprising a removable pin coupled between the flanges on each of the support blocks and configured to lock the support blocks to the flexible links, load supports coupled to the flexible links, or a combination thereof.

28. The system of claim 26, further comprising a tether assembly coupled between the two bodies in addition to the support assembly, the tether assembly comprising a transfer assembly.

29. A method for supporting at least two bodies having a flexible link coupled between the bodies with the flexible link having a tensile load, comprising:

coupling a first support block of a support assembly to a first portion of the flexible link between the two bodies;

allowing a support link coupled to the first support block to pivot to bring a second support block coupled to the support link distal from the first support block into proximity to a second portion of the flexible link between the two bodies that is distal from the first portion of the flexible link;

coupling the second support block of the support assembly to the second portion of the flexible link distally from the first portion of the flexible link; and using a remote operated vehicle to couple the first and second support blocks to the first and second portions of the flexible link.

30. The method of claim 29, further comprising adjusting a distance between the first and second support blocks using the support link.

31. The method of claim 29, further comprising coupling a tether assembly having a transfer assembly between the two bodies in addition to the support assembly, and transferring the tensile load from the flexible link to the tether assembly.

* * * * *